US010363675B2

(12) United States Patent
Robinson et al.

(10) Patent No.: US 10,363,675 B2
(45) Date of Patent: Jul. 30, 2019

(54) KNIFE AND SHEATH

(71) Applicant: WHG Properties, LLC, North Wales, PA (US)

(72) Inventors: Frank E. Robinson, Schwenksville, PA (US); William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 9 days.

(21) Appl. No.: 15/612,230

(22) Filed: Jun. 2, 2017

(65) Prior Publication Data

US 2018/0200903 A1 Jul. 19, 2018

Related U.S. Application Data

(60) Provisional application No. 62/446,229, filed on Jan. 13, 2017.

(51) Int. Cl.
*B26B 29/02* (2006.01)
*B26B 3/00* (2006.01)

(52) U.S. Cl.
CPC ..... *B26B 29/025* (2013.01); *B26B 3/00* (2013.01)

(58) Field of Classification Search
CPC ..... B26B 29/025; B26B 29/00; B26B 3/06; B26B 3/00; F41B 13/04; Y10T 224/904
USPC ..... 30/143; 7/167; 224/232, 245; D3/220
See application file for complete search history.

(56) References Cited

U.S. PATENT DOCUMENTS 675,118 A * 5/1901 Sweet ..... B26B 29/025 224/232
2,999,268 A * 9/1961 Strandengen ..... E05D 7/086 16/332
3,191,825 A * 6/1965 Beckwith ..... B26B 29/025 224/232
4,835,863 A 6/1989 Salandre
4,964,554 A * 10/1990 Collins ..... B26B 3/06 224/232
4,998,350 A * 3/1991 Thompson ..... B26B 29/025 224/232
5,001,834 A * 3/1991 Collins ..... B26B 29/025 30/151
D317,037 S 5/1991 Koshiishi
D321,548 S 11/1991 Collins
5,086,561 A 2/1992 Nathan
D334,791 S 4/1993 Collins
5,255,436 A * 10/1993 Yoshida ..... B26B 29/025 224/232
5,379,520 A 1/1995 Collins
D369,673 S 5/1996 Morton et al.
D378,243 S 3/1997 Seber
5,647,130 A 7/1997 Collins
D384,724 S 10/1997 Uke et al.

(Continued)

*Primary Examiner* — Jason Daniel Prone
*Assistant Examiner* — Samuel A Davies
(74) *Attorney, Agent, or Firm* — Fox Rothschild LLP

(57) ABSTRACT

A sheath for a knife includes a main body that includes a top face, a front face and a pair of side faces. The front face is wider than the side faces. The sheath includes a cavity that is defined by the main body. The cavity includes an opening in the top face and is configured to receive at least a portion of the knife. The sheath includes a latch that is disposed in the main body. The latch is spring loaded and has a projection as least partially positionable within the cavity.

16 Claims, 25 Drawing Sheets

(56) References Cited

U.S. PATENT DOCUMENTS

| | | | | |
|---|---|---|---|---|
| 6,053,929 | A * | 4/2000 | Cohn | A61B 17/3213 30/151 |
| D448,442 | S | 9/2001 | Cheng | |
| 6,457,240 | B1 | 10/2002 | Liu | |
| D467,634 | S | 12/2002 | Eickhorn | |
| D476,394 | S | 6/2003 | Trbovich, Jr. | |
| D491,622 | S | 6/2004 | Hadley et al. | |
| D558,851 | S | 1/2008 | Onion | |
| D610,646 | S | 2/2010 | Harsey, Jr. et al. | |
| D704,793 | S | 5/2014 | Dahan | |
| D709,982 | S | 7/2014 | Freeman et al. | |
| D714,047 | S | 9/2014 | Ko | |
| D724,312 | S | 3/2015 | Wikstrom et al. | |
| D746,585 | S | 1/2016 | Burge et al. | |
| D809,786 | S | 2/2018 | Dingel | |
| D813,341 | S | 3/2018 | Jaramus et al. | |
| D816,431 | S | 5/2018 | Yeh | |
| D831,953 | S | 10/2018 | Dobbs | |
| 2003/0085244 | A1* | 5/2003 | Parsons | A45F 5/02 224/197 |
| 2013/0026054 | A1* | 1/2013 | Adams | A45F 5/14 206/349 |

* cited by examiner

KNIFE AND SHEATH

BACKGROUND

A knife can be carried and stored in a sheath. Typically, the sheath protects and covers at least the edge of the knife. In order to retain a knife within a sheath, pinch points (i.e., friction) and straps are commonly used. However, when the user needs to use the knife that is located within the sheath, quick deployment of the knife is imperative. This requires that the retention means be easy to operate, even in a high stress situation. Also, when not in use, retention of the knife within the sheath is very important for safety and reliability purposes. Therefore, improvements in a knife and sheath design that allows for quick deployment while also maintaining sufficient retention are needed.

SUMMARY

The present disclosure relates generally to a knife and sheath.

In one aspect of the present disclosure a sheath for a knife is disclosed. The sheath includes a main body that includes a top face, a front face and a pair of side faces. The front face is wider than the side faces. The sheath includes a cavity that is defined by the main body. The cavity includes an opening in the top face and is configured to receive at least a portion of the knife. The sheath includes a latch that is disposed in the main body. The latch is spring loaded and has a projection as least partially positionable within the cavity.

In another aspect of the present disclosure a sheath and knife combination is disclosed. The sheath and knife combination includes a knife and a sheath. The knife includes a tang and a blade. The sheath includes a main body that has a least a top face, a front face, and a pair of side faces. The front face is wider than the side faces. The sheath includes a cavity that is defined by the main body. The cavity has an opening in the top face and the cavity is sized and shaped to receive at least the blade of the knife. The sheath and knife combination includes a latch that is disposed in the main body. The latch is spring loaded and has a projection as least partially positionable within the cavity.

In one aspect of the present disclosure a sheath for a knife is disclosed. The sheath includes a main body that includes a top face, a front face and a pair of side faces. The front face is wider than the side faces. The sheath includes a cavity that is defined by the main body. The cavity includes an opening in the top face and is configured to receive at least a portion of the knife. The sheath includes an adjustable knife retention element that is disposed in the main body. The adjustable knife retention element is at least partially positioned within the cavity and is configured to exert a force on the knife when positioned within the cavity.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings.

DETAILED DESCRIPTION

Figure 1:
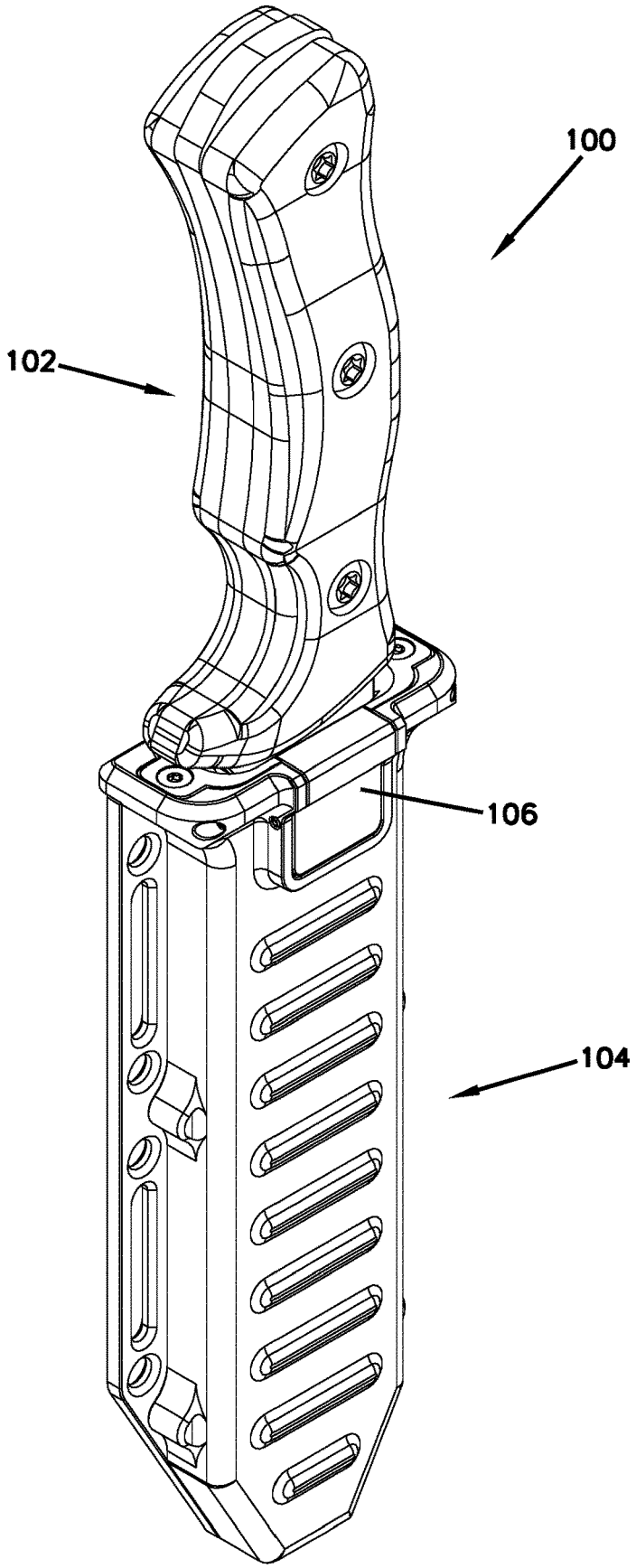
FIG. 1 illustrates a front perspective view of an example knife and sheath combination, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
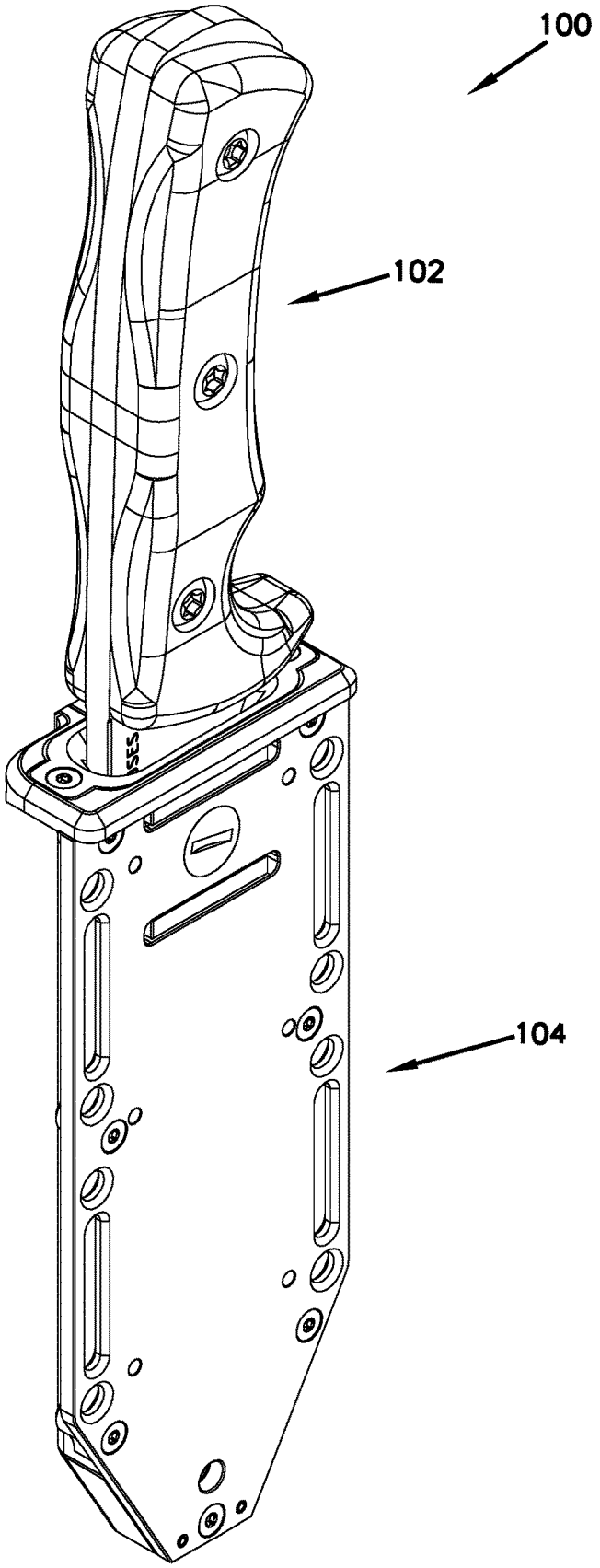
FIG. 2 illustrates a rear perspective view of the knife and sheath combination of FIG. 1.
Figure 3:
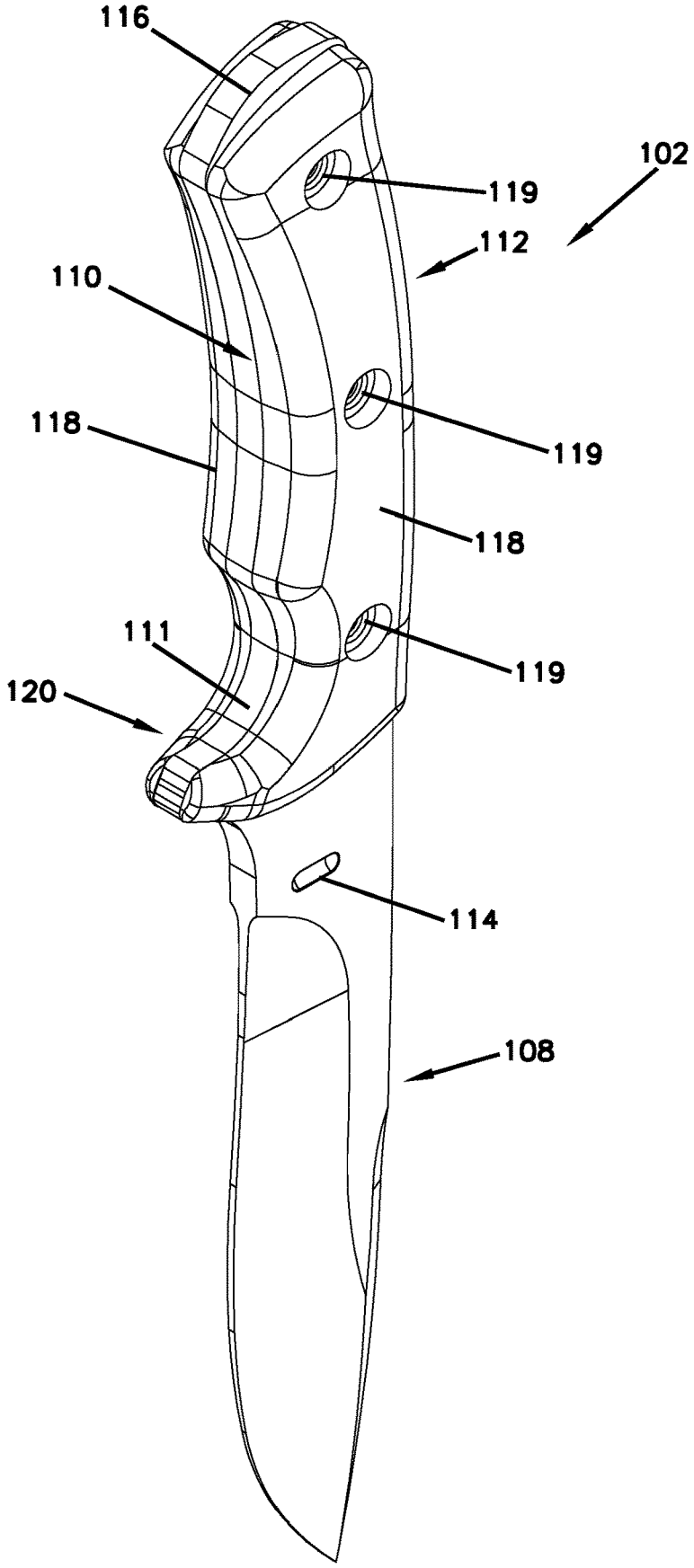
FIG. 3 illustrates a perspective view of the knife of FIG. 1.
Figure 4:
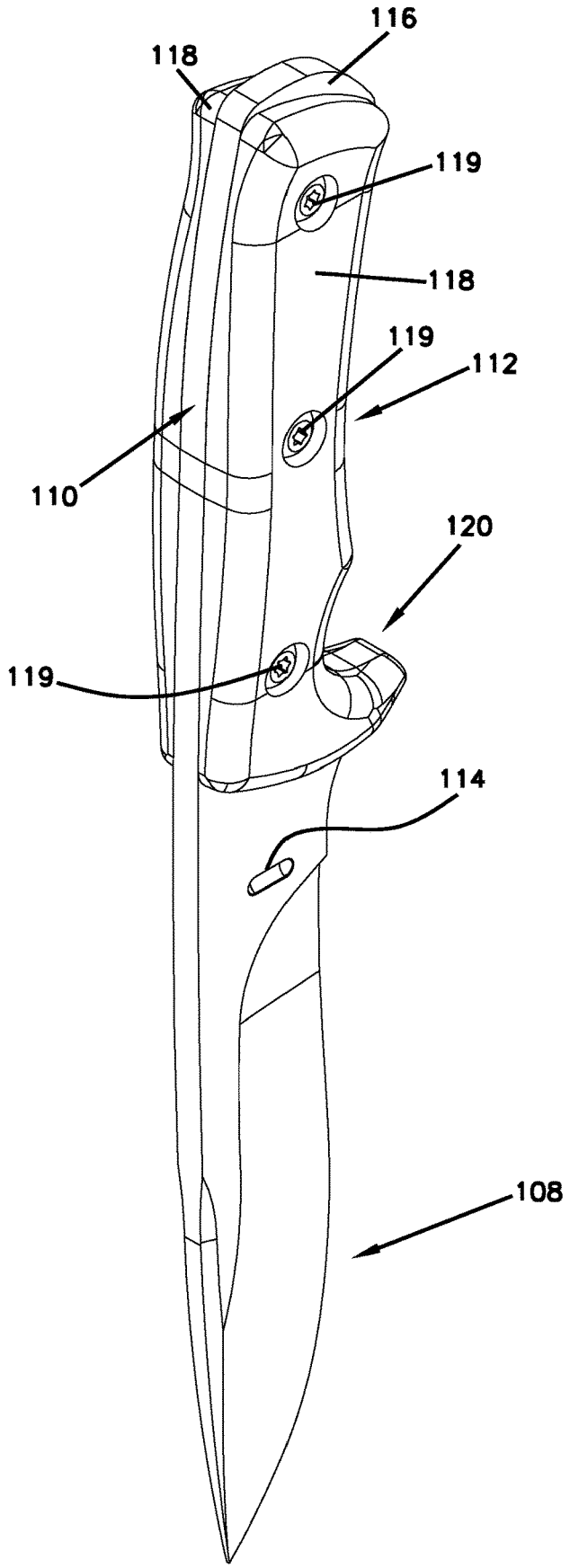
FIG. 4 illustrates another perspective view of the knife of FIG. 1.
Figure 5:
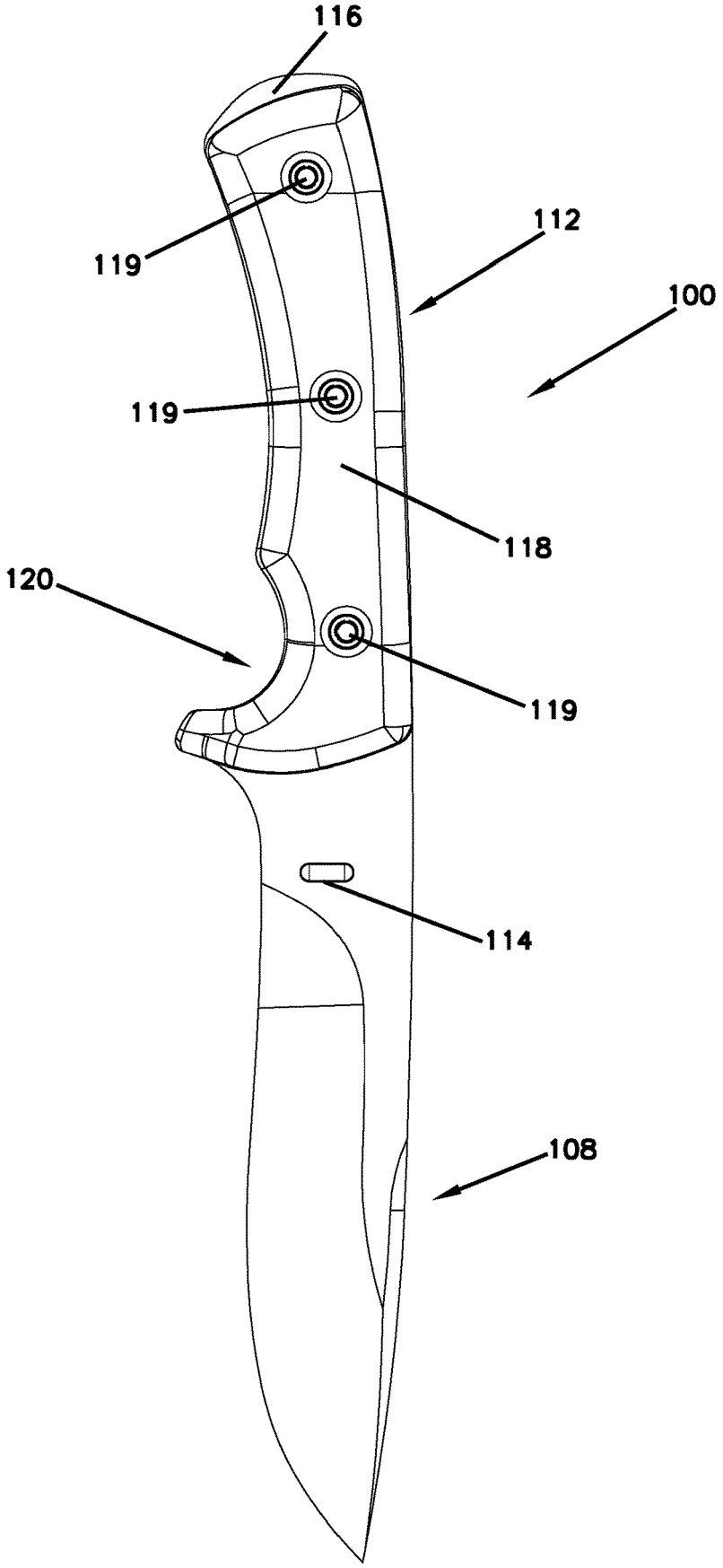
FIG. 5 illustrates a side view of the knife of FIG. 1.
Figure 6:
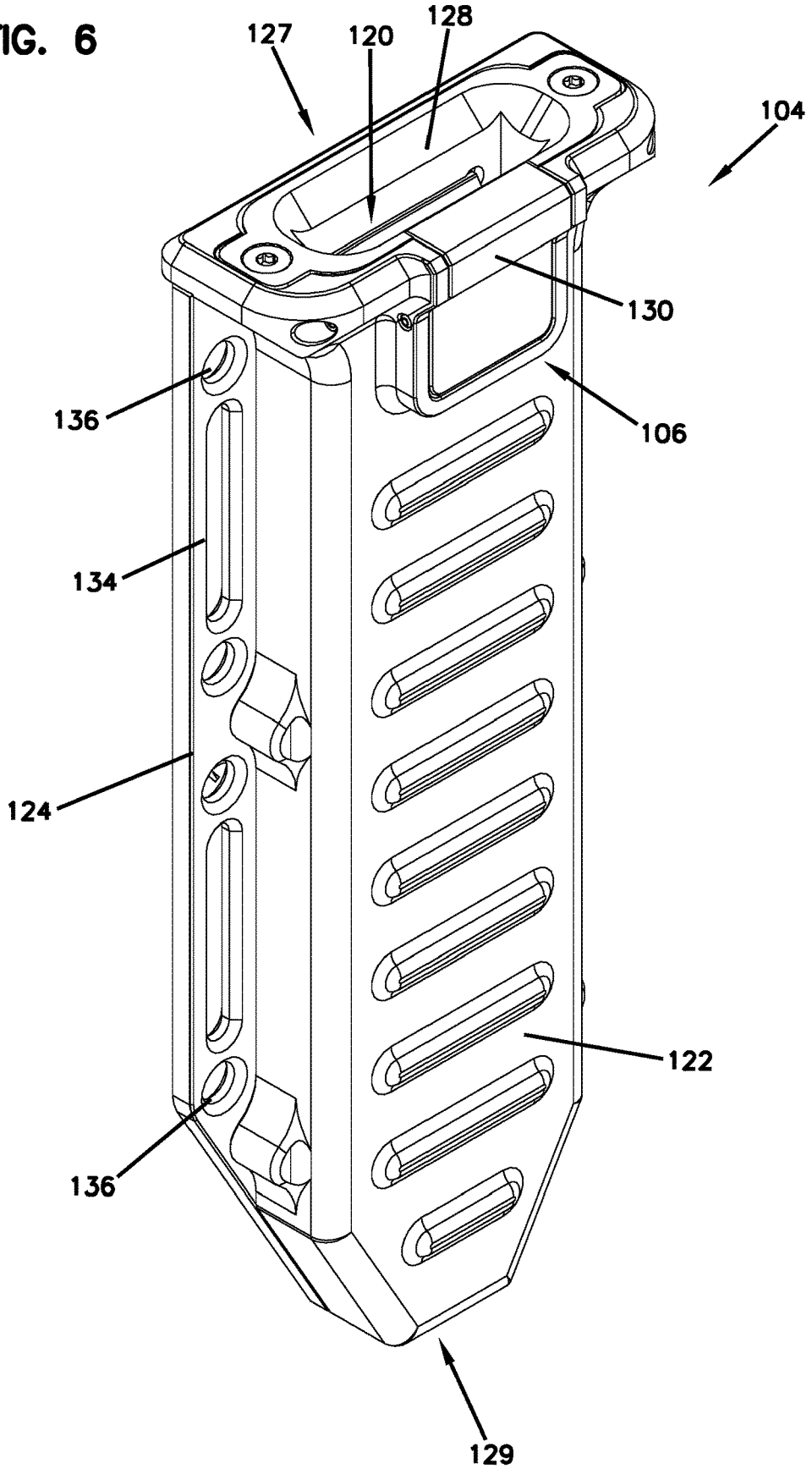
FIG. 6 illustrates a front perspective view of the sheath of FIG. 1.

FIGS. 1 and 2 are perspective views of an example of a knife and sheath combination 100. In this example, a knife 102 is secured within a sheath 104.

The knife and sheath combination 100 are configured to be carried by a user for utility or combat use. In some examples, the knife and sheath combination 100 may be secured to a piece of clothing or equipment. The knife 102 is configured to be retained in the sheath 104 by way of a latch 106 disposed within the sheath 104. In some examples, the knife 102 can be inserted and retained within the sheath 104 in either a left-hand orientation or a right-hand orientation; therefore, the knife and sheath combination 100 is ambidextrous. Further, in some examples, the knife and sheath combination 100 is ruggedized so that the knife and sheath combination 100 can withstand harsh environments and resist wear, stress, and abuse. In some examples, the knife and sheath combination 100 can include materials and/or coatings to help ruggedize the knife and sheath combination 100.

FIGS. 2-5 show an example of the knife 102. The knife 102 includes a blade 108, a tang 110, and a handle 112. The knife 102 can be of a variety of lengths and constructed from a variety of different materials. In some embodiments, the knife 102 is at least partially ornamental in nature and features nonfunctional elements.

In the depicted example, the blade 108 is a drop point blade. However, it is considered within the scope of the present disclosure that the blade 108 can have other blade shapes such as a clip point, tanto, serrated or other. In some examples, the blade 108 can be coated to increase corrosion resistance, resist reflection, and allow for easier cleaning. In some examples, the blade 108 can be constructed of PD-1 steel and be differentially hardened.

The blade 108 also includes at least one slot 114. In the depicted embodiment, the blade 108 includes a pair of slots 114 located at either side of the blade 108. In some examples, the slot 114 can be an aperture that passes completely through the blade 108. In other examples, each slot 114 is an indention that does not pass completely through the blade 108.

In other examples, the blade 108 can include a thumb ramp or a finger guard.

In the depicted example, the knife 102 includes a full tang 110. In other examples, the knife 102 can have other tang constructions such as a partial tang or a skeletonized tang. The handle 112 of the knife 102 is configured to surround at least a portion of the tang 110. In some examples, a portion 116 of the tang 110 can be exposed at an end of the tang 110, opposite of the blade 108. The exposed portion 116 can be utilized as a pommel and can be used as a hammer or a glass breaking tool. In some examples, the tang 110 has a shape that is generally similar to the shape of the handle 112. For instance, in some examples, the tang 110 can include a finger guard 111 that follows the shape of the handle 110.

In the depicted embodiment, the handle 112 has a two-piece construction that includes a pair of sides 118. The sides 118 are secured to one another and to the tang 110 of the knife 102 by way of fasteners 119. In the depicted embodiment, the handle 112 includes three fasteners 119 that are configured to join the side 118 to the tang 110. The handle 110 further includes a finger groove 120 that can aid the user is maintaining a grip on the knife 102 while also protecting the finger of the user. In some examples, the handle 110 can be constructed of a phenolic laminate. In other examples, the handle 110 can utilize other synthetic materials or organic materials, such as wood.

FIGS. 6-9 show an example of the sheath 104. As noted above, the sheath 104 is configured to receive and retain the knife 102. However, the sheath 104 can be used with a variety of different knives. The sheath 104 includes the latch 106, a front portion 122, a back portion 124, a cavity 126, and a removable liner 128. The knife 102 is to be received into the sheath 104 at a top 127 and positioned within the cavity 126, which is lined by the removable liner 128. In some examples, the sheath 104 does not include a liner 128 and the cavity 126 directly receives the knife 102. In some embodiments, the sheath 104 is at least partially ornamental in nature and features nonfunctional elements.

The latch 106 is disposed in the front portion 122 of the sheath 104 and configured to secure the knife 102 within the sheath 104. The latch 106 includes a button 130 that is operable by the user to selectively remove the knife 102 from the sheath 104. In some examples, the button 130 is pivotable. The latch 106 will be described in more detail with respect to FIGS. 12-17 herein.

Figure 7:
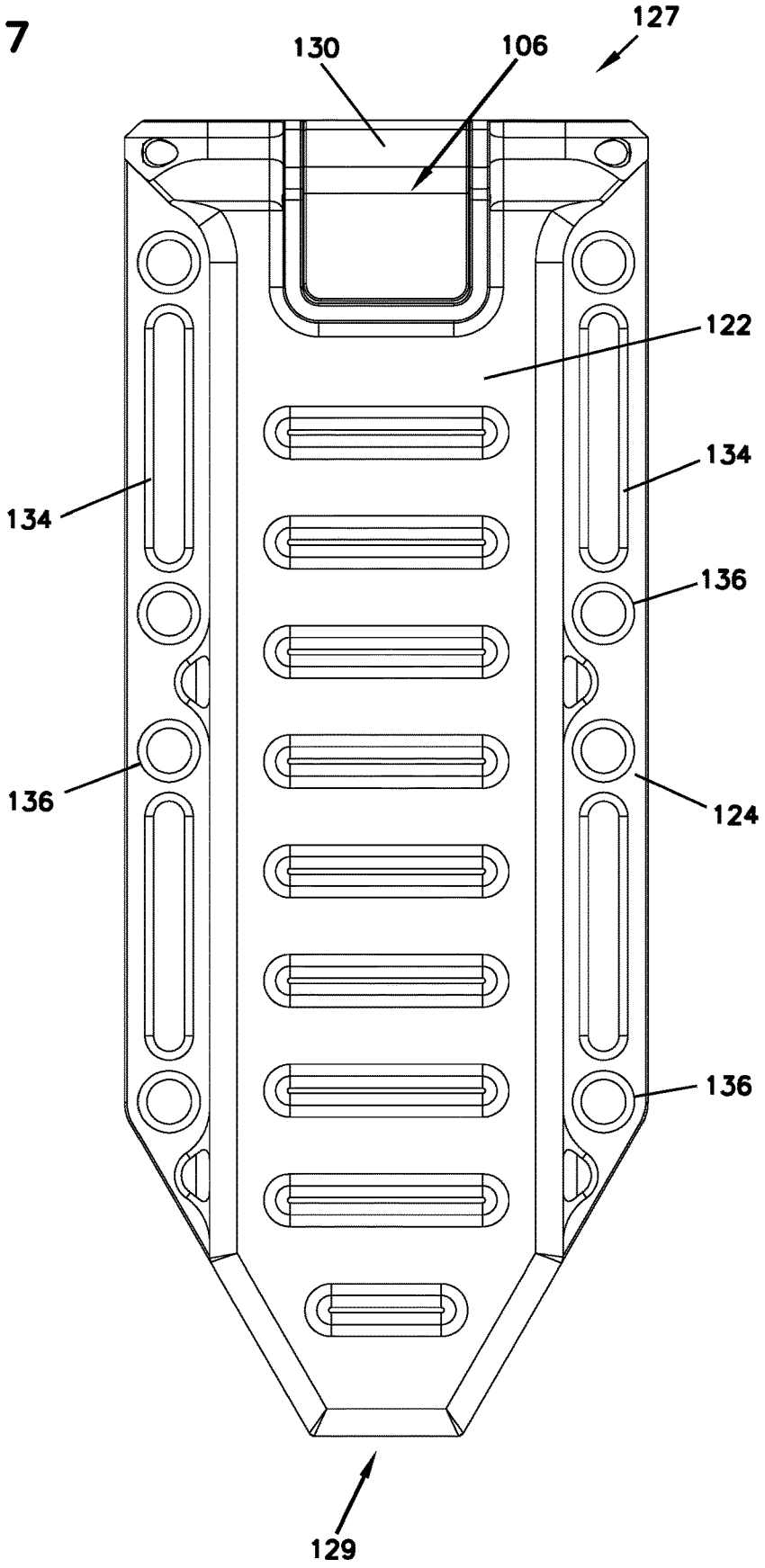
FIG. 7 illustrates a front view of the sheath of FIG. 1.

FIG. 7 shows the front of an example of the sheath 104. The front portion 122 of the sheath 104 is attached to the back portion 124. The front portion 122 can be separated from the back portion 124 for maintenance (see FIG. 12). In some examples, the front portion 122 can be manufactured from metal. In some examples, it is machined from aluminum. In some examples, the aluminum is anodized. In some examples, the front portion 122 and back portion 124 can define the cavity 126 for positioning of the removable liner 128 therein.

Figure 8:
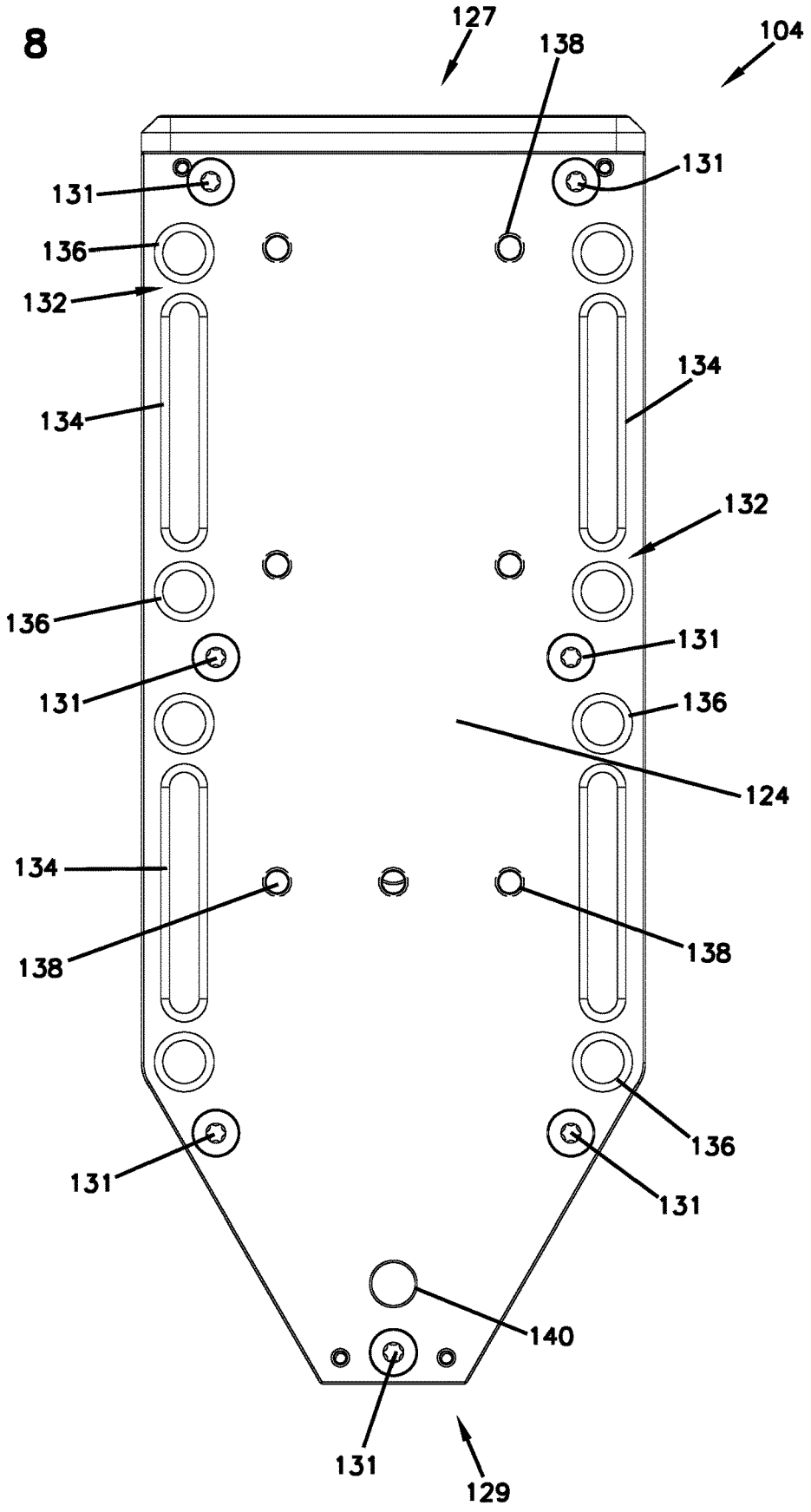
FIG. 8 illustrates a rear view of the sheath of FIG. 1.

FIG. 8 shows an example of the back of the sheath 104. The back portion 124 is attached to the front portion 122 by a plurality of fasteners 131. In some examples, the fasteners 131 are screws. A plurality of attachment points 132 are disposed in the back portion 124. The attachment points 132 can include, but are not limited to, webbing strap apertures 134, cordage apertures 136, and mounting plate apertures 138. In one example, the webbing strap apertures 134 can be sized and shaped to receive at least a one-inch-wide webbing strap (not shown) for mounting the sheath 104 to clothing or to other equipment. In one example, the cordage apertures 136 can be sized and shaped to receive paracord. In one example, the mounting plate apertures 138 can be arranged on the back portion so as to be configured to receive a mounting plate (see FIGS. 10-11).

The back portion 124 also includes a drain hole 140 positioned at a bottom 129 of the sheath 104. The drain hole 140 passes through the back portion 124 and into the cavity 126 so as to allow water to drain from the cavity 126. Further, in some examples, the back portion 124 can be manufactured from metal. In some examples, it is machined from aluminum. In some examples, the aluminum can be anodized.

Figure 9:
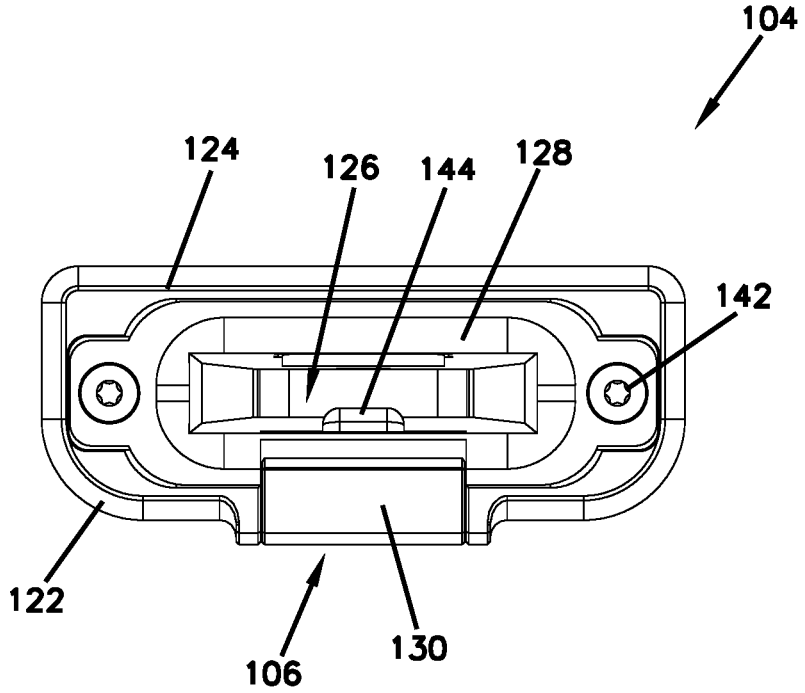
FIG. 9 illustrates a top view of the sheath of FIG. 1.

FIG. 9 shows a top view of an example of the sheath 104. In some examples, the cavity 126 is defined by the front portions 122. The cavity 126 is sized and shaped to receive at least the blade 108 of the knife 102. However, it is considered within the scope of the present disclosure that the cavity 126 can be a variety of different shapes to accommodate a variety of different knives. The cavity 126 is lined by the removable liner 128 which is secured to the front portion 122 by way of at least one fastener 142. The removable liner 128 is constructed of a material that is configured to not damage the blade 108 of the knife 102. In some examples, this material is a polymer. Similar to the cavity 126, the removable liner 128 can be a variety of different shapes to accommodate a variety of different knives.

FIG. 9 also shows the top view of an example of the latch 106. The latch 106 also includes a projection 144 that is positionable within the cavity 126. The projection 144 is sized and shaped to interface with the knife 102 when the knife 102 is positioned within the cavity 126. As will be discussed in more detail with respect to FIGS. 12-17, the projection 144 is movable with the button 130 of the latch 106 so as to allow the user to release the knife 102 from the sheath 104.

Figure 10:
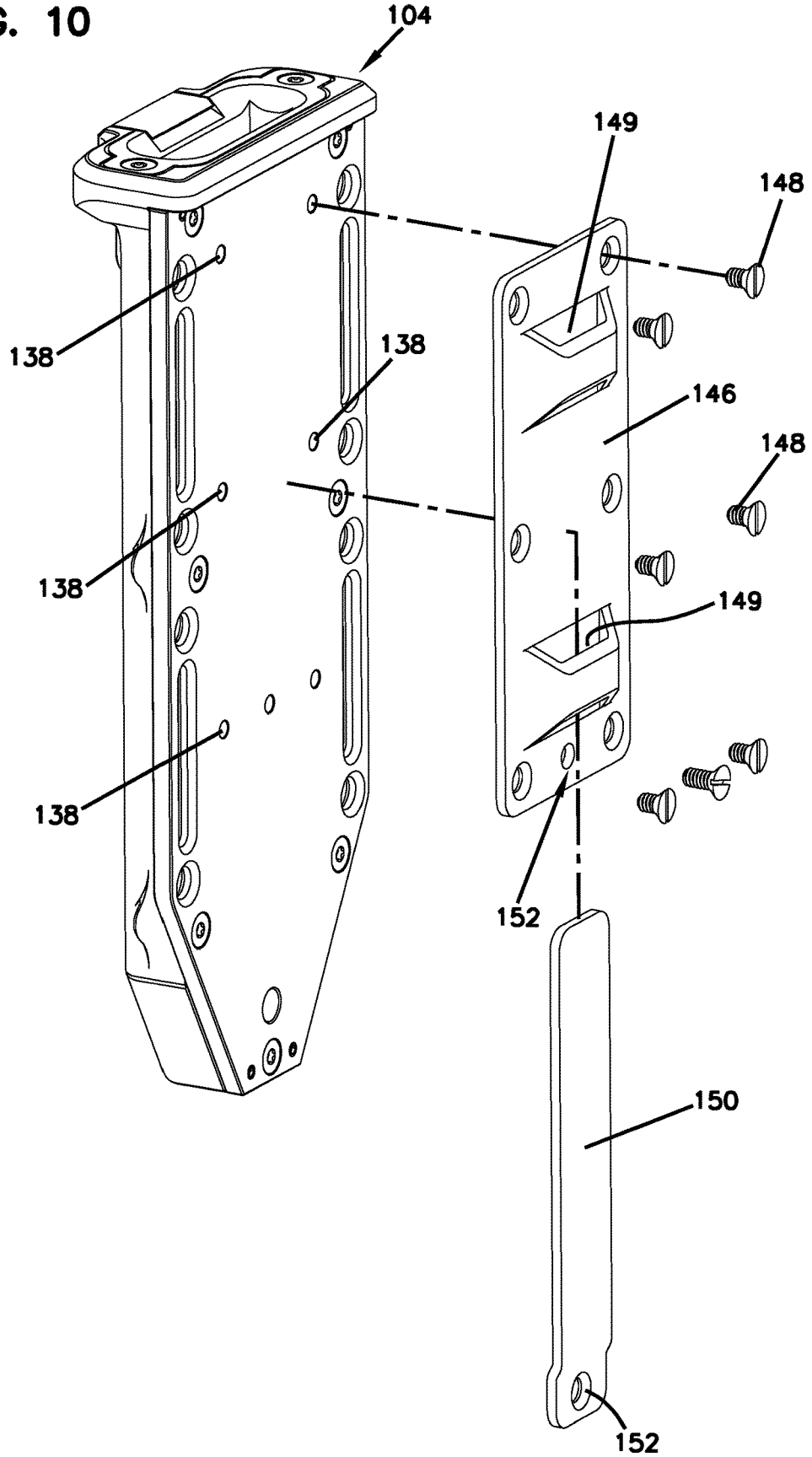
FIG. 10 illustrates a partially exploded view of a mounting solution for the sheath of FIG. 1, according to one embodiment of the present disclosure.

FIG. 10 depicts one example mounting solution for the sheath 104. Specifically, FIG. 10 shows an example of the sheath 104 and a MOLLE mounting plate 146. The MOLLE mounting plate 146 is configured to attach via fasteners 148 to the mounting plate apertures 138 on the back portion 124 of the sheath 104. The MOLLE mounting plate 146 includes a pair of slots 149 to receive a mounting bar 150 therethrough. The mounting bar 150 can then be secured at an attachment point 152 to the MOLLE mounting plate 146. The MOLLE mounting plate 146 and mounting bar 150 allow the sheath 104 to be mounted to any MOLLE system (e.g., a system that incorporates the use of corresponding rows of nylon webbing stitched onto a piece of equipment). This allows the user freedom to mount the sheath to either a MOLLE-compatible clothing system or to MOLLE-compatible equipment.

Figure 11:
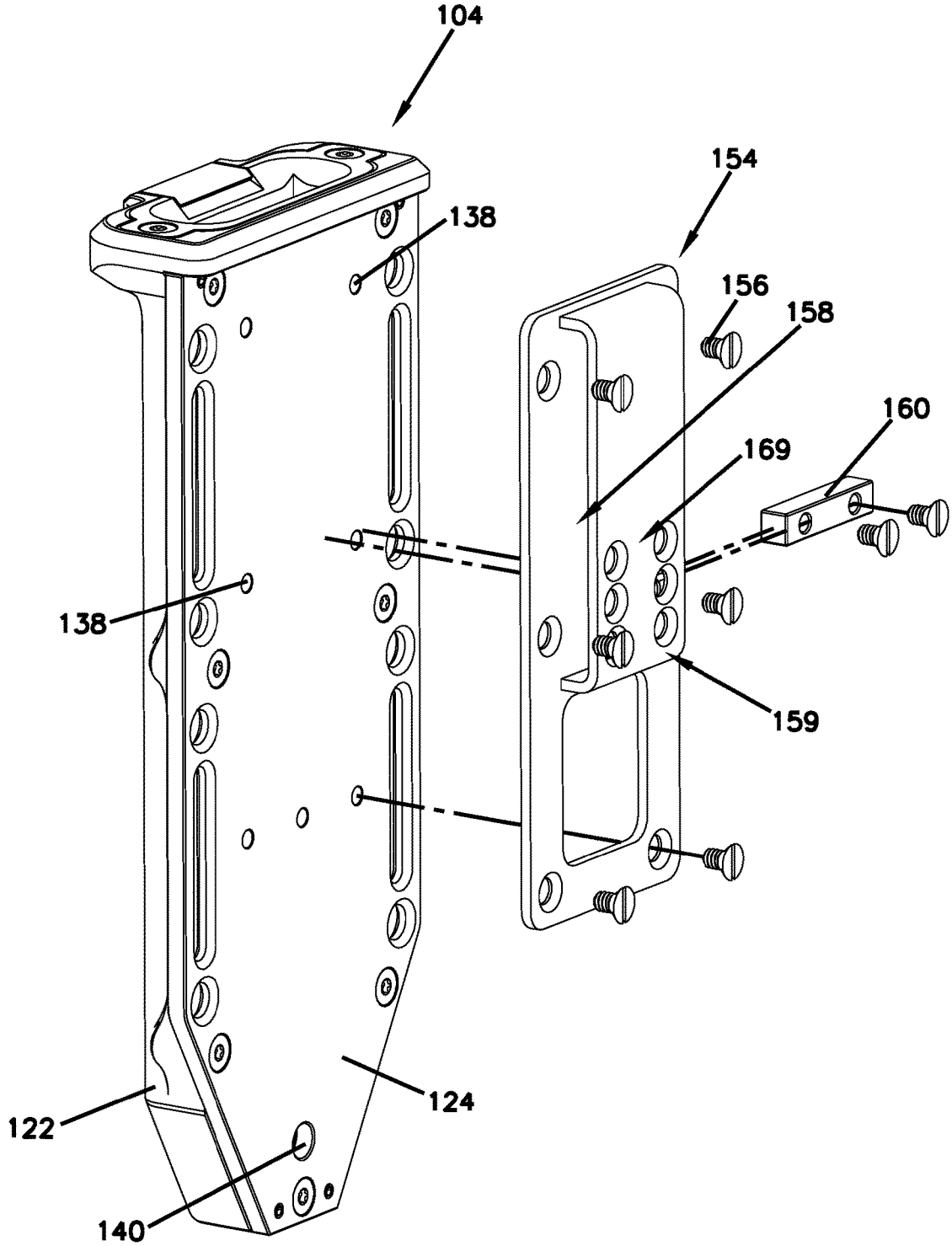
FIG. 11 illustrates a partially exploded view of another mounting solution for the sheath of FIG. 1, according to one embodiment of the present disclosure.

FIG. 11 depicts another example mounting solution for the sheath 104. Specifically, FIG. 11 shows the sheath 104 and a belt mounting plate 154. The belt mounting plate 154 is configured to attach via fasteners 156 to the mounting plate apertures 138 on the back portion 124 of the sheath 104, similar to the MOLLE mounting plate 146 described above. The belt mounting plate 154 includes a slot 158 for receiving a belt or other strap therethrough. The width of the slot 158 is customizable by way of a block 160 that secures to the belt mounting plate 154 at a plurality of locations 159 within the slot 158. In the depicted example, the block 160 can be secured within the slot 158 at three separate locations 159 so as to change the width of the slot 158 for mounting to a variety of different belt sizes. In some examples, the belt mounting plate 154 can include more or less mounting locations for the block 160. In further examples still, the belt mounting plate 154 can optionally not include the block 160.

Figure 12:
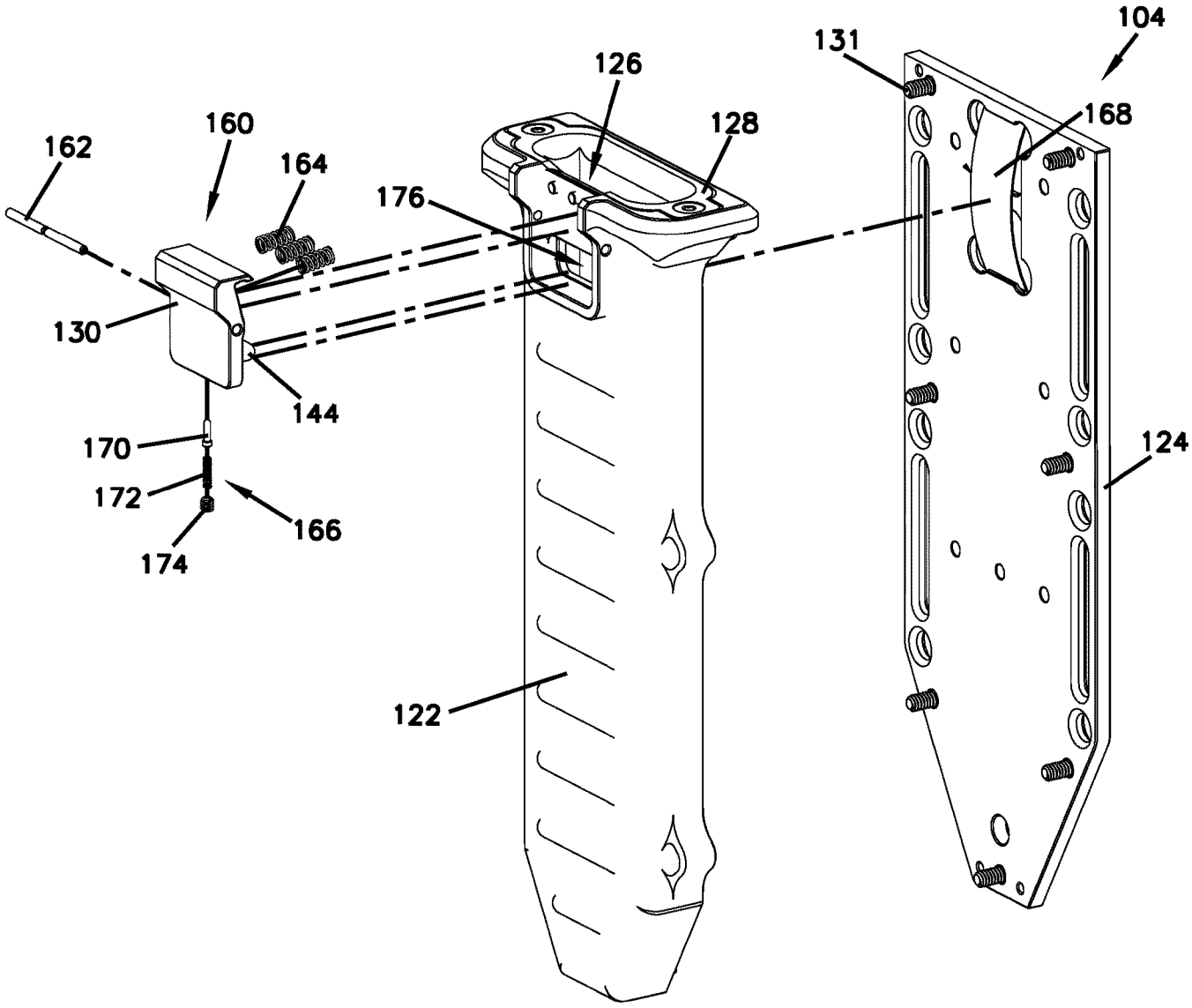
FIG. 12 illustrates a partially exploded view of the sheath of FIG. 1.

FIG. 12 shows a partially exploded view of an example of the sheath 104. Specifically, the front portion 122 is shown separated from the back portion 124. Further, the latch 106 is shown separated from the front portion 122. The latch 106 is shown to include the button 130, the projection 144, a latch pin 162, a series of springs 164, and a detent assembly 266. Further, the back portion 124 is shown to include a friction spring 168 attached thereto.

The button 130 of the latch 106 is pivotable about the latch pin 162, which is secured through the button 130 and into the front portion 122 of the sheath 104. Further, the button 130 is spring loaded by the series of springs 164 and biased to a latched position, as will be discussed in further detail with respect to FIGS. 14-15. In some examples, the latch 106 may include just a single spring 164 so as to spring load the button 130. The springs 164 can be changed to alter the operation of the latch 106, specifically the button 130. Further, the projection 144, which is attached to the button 130, can pass in and out of the cavity 126 by way of a window 176 in the front portion 122 when the button 130 is pivoted about the latch pin 162.

The detent assembly 266 retains the latch pin 162. The detent assembly 266 includes a pin 1670, a spring 172, and a set screw 174. The detent assembly 266 is positioned within the button 130, and the pin 170 is configured to interface with a notch in the latch pin 162. To adjust the amount of resistance the pin 170 provides, the user can either tighten or loosen the set screw 174.

The friction spring 168 is optional in the sheath 104. In the depicted example, the friction spring 168 is secured to the back portion 124 and is configured to pass into the cavity 126. The friction spring 168 can provide extra pressure to the blade 108 of the knife 102 when the knife 102 is positioned within the cavity 126 so to prevent any jostling of the knife 102 within the cavity 126 and to aid in retention. In some examples, the spring 168 is a stainless steel spring. In other examples, the spring 168 may be constructed of a synthetic plastic material.

Figure 13:
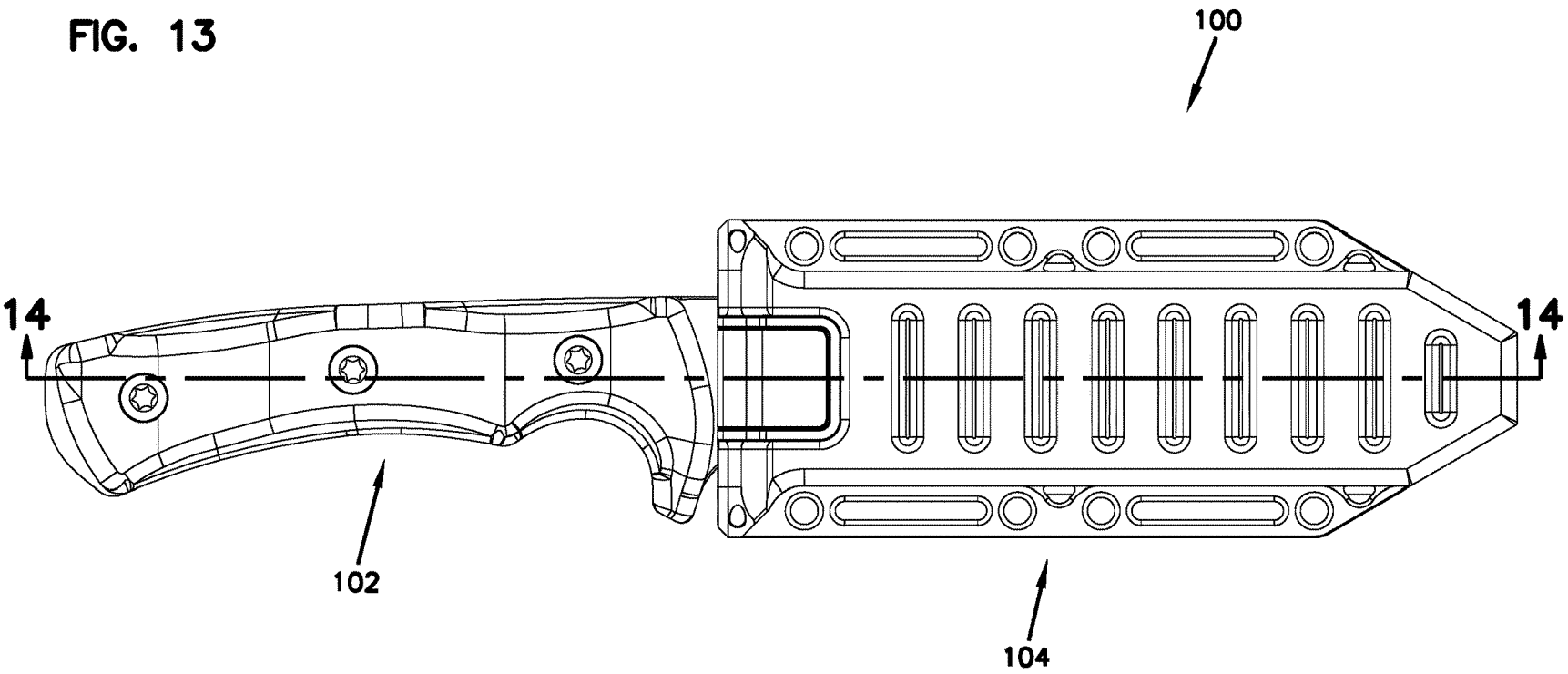
FIG. 13 illustrates a front view of the knife and sheath combination of FIG. 1.
Figure 14:
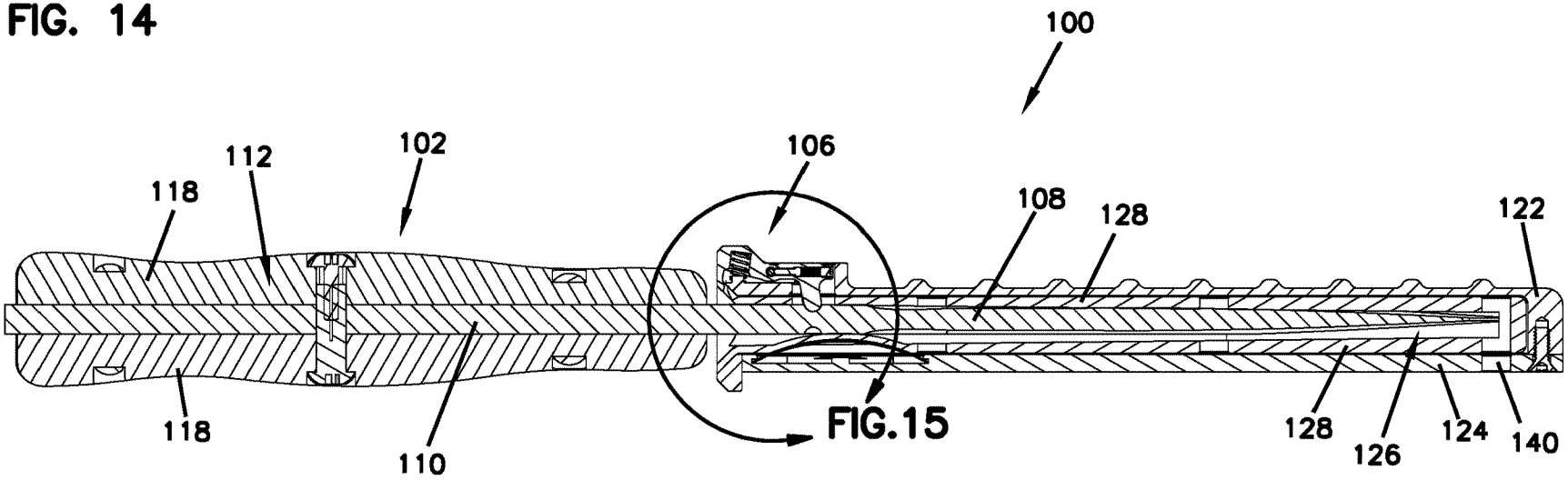
FIG. 14 illustrates a cross-sectional view along line 14-14 in FIG. 13.

FIG. 13 shows a front view of an example of the knife and sheath combination 100 with the knife 102 latched within the sheath 104. FIG. 14 shows a cross-sectional view along line 14-14 in FIG. 13. As shown, the blade 108 is positioned within the cavity 126 of the sheath 104.

Figure 15:
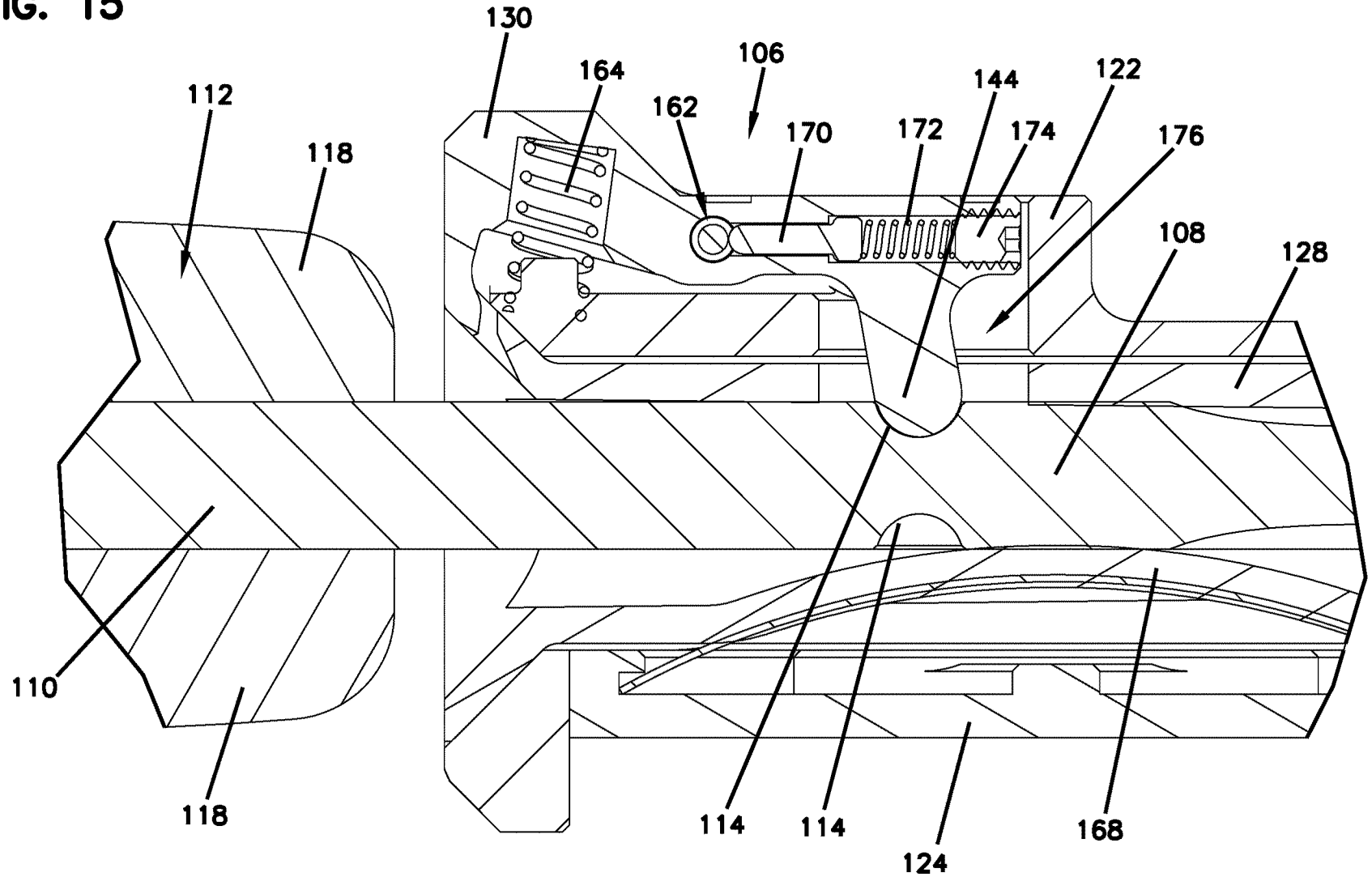
FIG. 15 illustrates a blown up view about circle C in FIG. 14 of the latch in the latched position.

FIG. 15 shows a blown-up portion of FIG. 14 about circle C. FIG. 15 shows the latch 106 in the latched position. In the latched position, the latch 106 retains the blade 108 of the knife 102 within the cavity 126 of the sheath 104. Specifically, the projection 144 of the latch 106 is positioned within the window 176 and cavity 126 so as to engage and interface with the slot 114 on the blade 108 of the knife 102. In the depicted example, the projection 144 is sized and shaped so as to fit within the slot 114 of the blade 108. Due to the location of the latch pin 162 and the location of the spring 164, the spring 164 applies an outward force to the button 130 which causes the projection 144 to be spring biased toward the latched position. Further aiding in retention, the friction spring 168 applies pressure to the blade 108 toward the projection 144. Due to the position of the latch pin 162, and the fact that the projection 144 extends from the button 130 at a non-perpendicular angle with the blade 108, forces applied away from the sheath 104 on the knife 102 are unable to dislodge the blade 108 from the cavity 126.

The non-perpendicular positioning of the projection 144 with both the knife 102 and the longitudinal axis of the cavity 126 also allows the knife 102 to be inserted into the sheath 104 without operating the button 130. This allows for a user to simply insert the knife 102, upon which the projection 144 slides open until it reaches the slot 114. At such a time, the projection will interface with the slot 114, thereby locking the blade 108 within the cavity. Therefore, the latch 106 automatically locks the knife 102 within the sheath 104 when the knife 102 is inserted.

As can be seen from FIG. 15, the projection 144 can also interface with the slot 114 on the opposite side of the blade 108 so as to allow the user to insert the blade 108 into the sheath in either direction.

Figure 16:
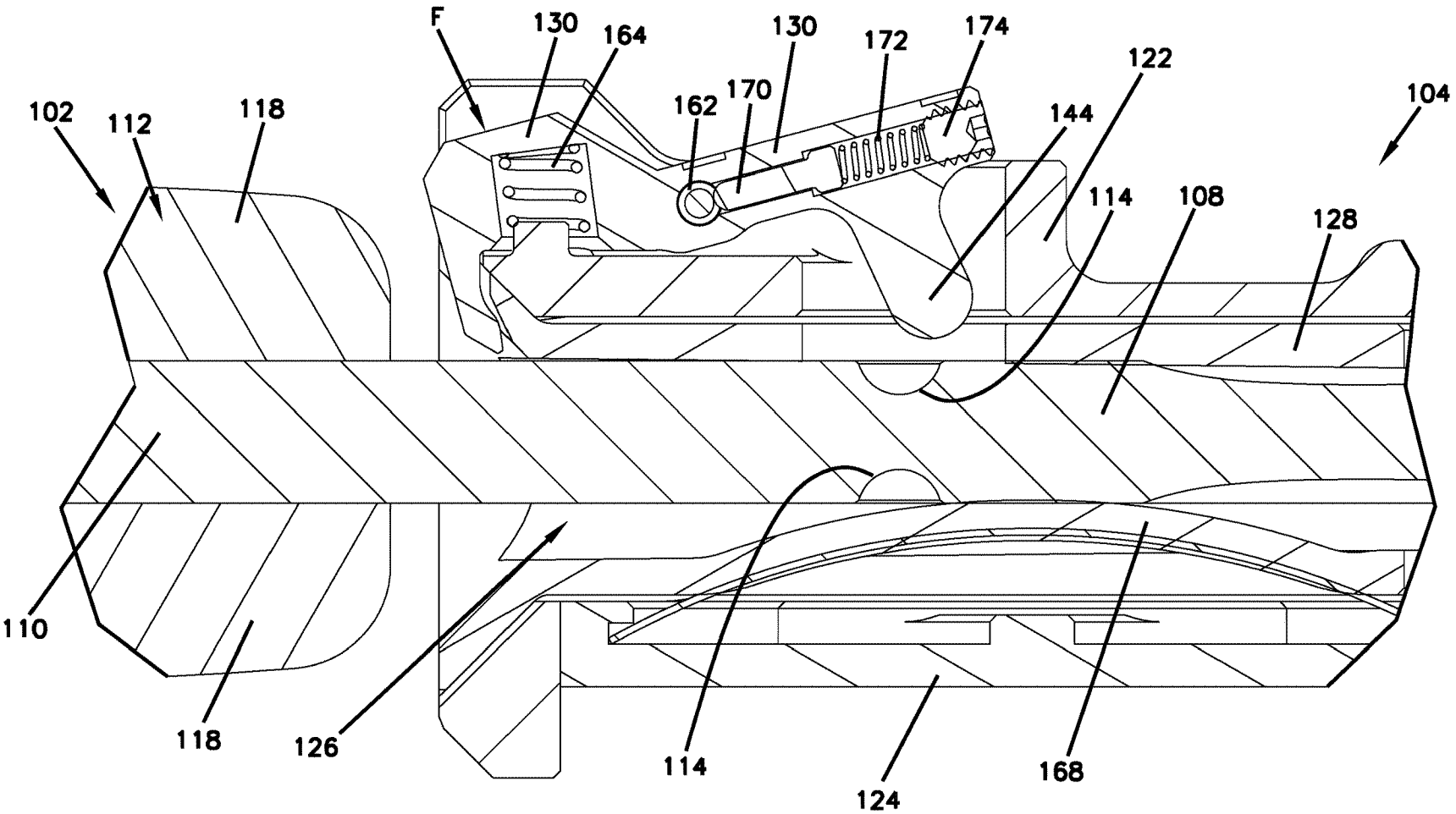
FIG. 16 illustrates another blown up view about circle C in FIG. 14 of the latch in the released position.

FIG. 16 shows an example of the latch 106 in the released position. To remove the knife 102 from the sheath 104, a force F is applied to the button 130 (as shown by an arrow). This force F pivots the button 130 and the projection 144 so that the projection 144 is removed from the cavity 126 and disengaged from the slot 114 of the blade 108. The user can then easily pull the knife 102 away from the sheath 104. To control the resistance of the rotation of the button 130, the set screw 174 of the detent assembly 266 can either be tightened or loosened.

Figure 17:
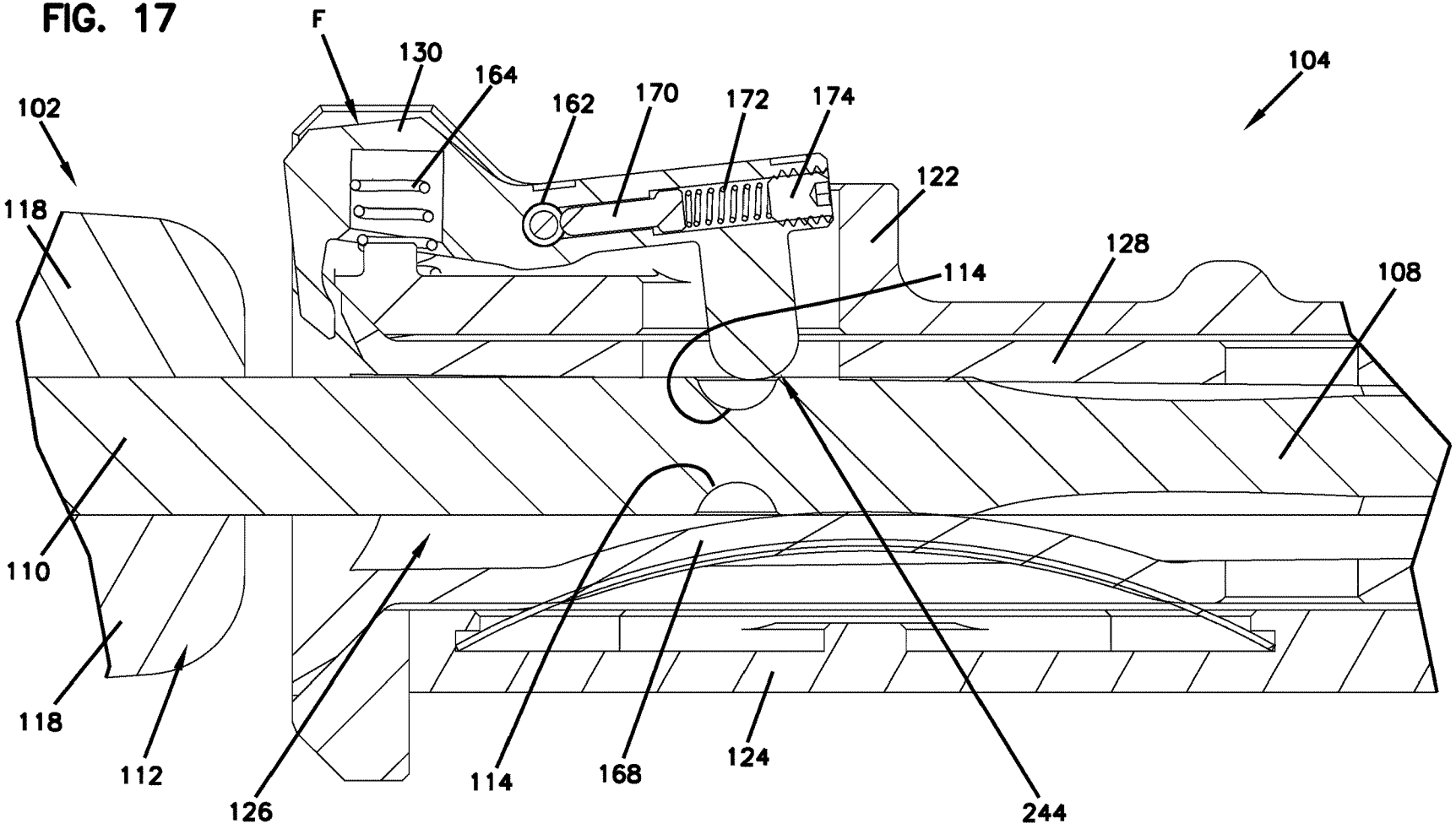
FIG. 17 illustrates another blown up view of a latch in the released position, according to one embodiment of the present disclosure.

FIG. 17 shows an example of the latch in the released position. As shown, the latch 106 includes a projection 244, according to an additional embodiment of the present disclosure. The projection 244 is sized and shaped so as to not fit within the slot 114 of the blade 108. Therefore, the projection 244 retains the blade 108 by way of friction. In some examples the projection 244 can be rubberized so as to further grip the blade. In other examples still, the projection 244, in combination with the friction spring 168, can exert opposing forces on the blade 108 to retain the blade within the sheath 104. In some examples, the latch 106 can be removable from the sheath 104 so that the user can change between the projection 144 and the projection 244.

Figure 18:
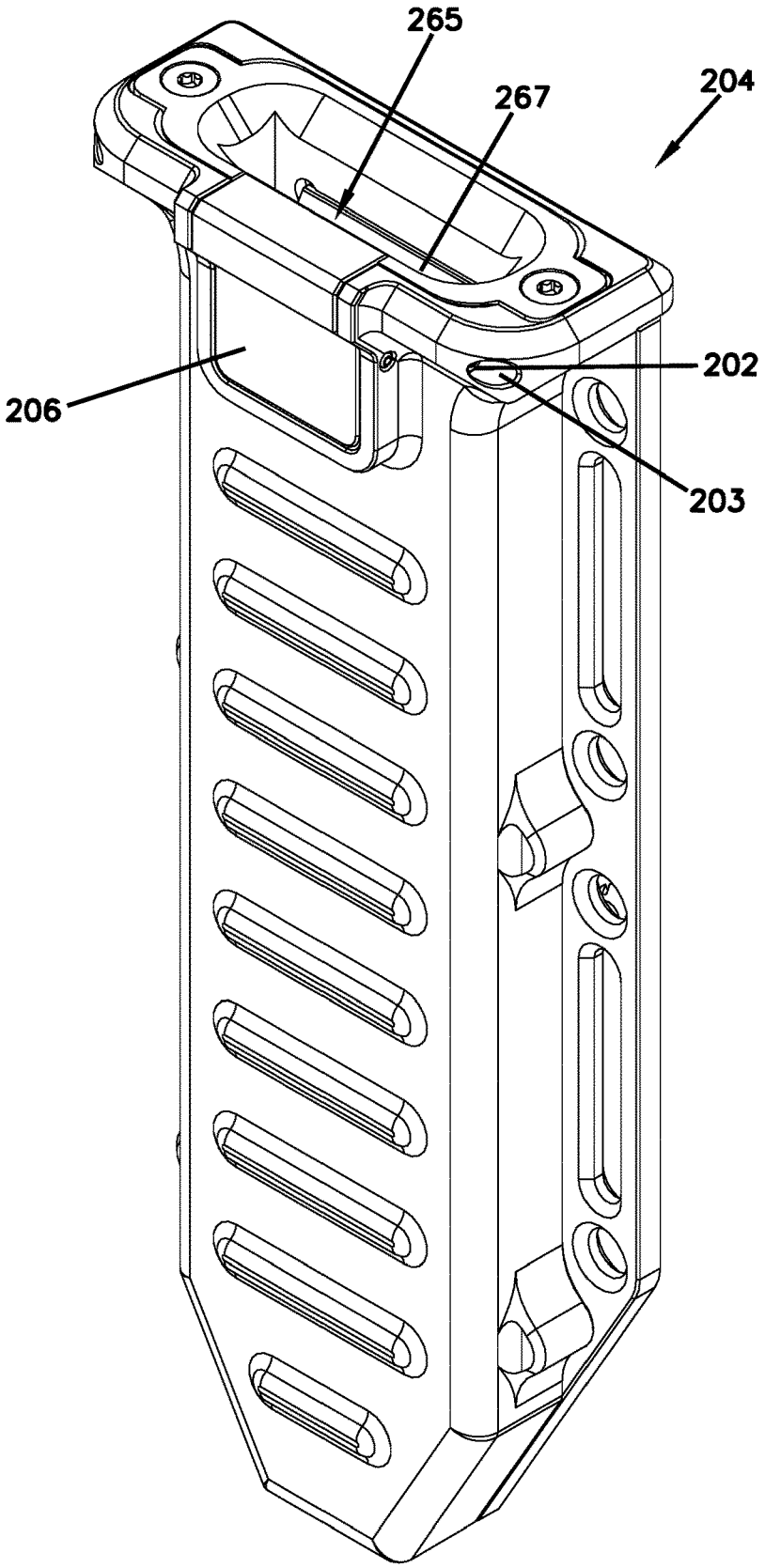
FIG. 18 illustrates a front perspective view of a sheath according to one embodiment of the present disclosure.
Figure 19:
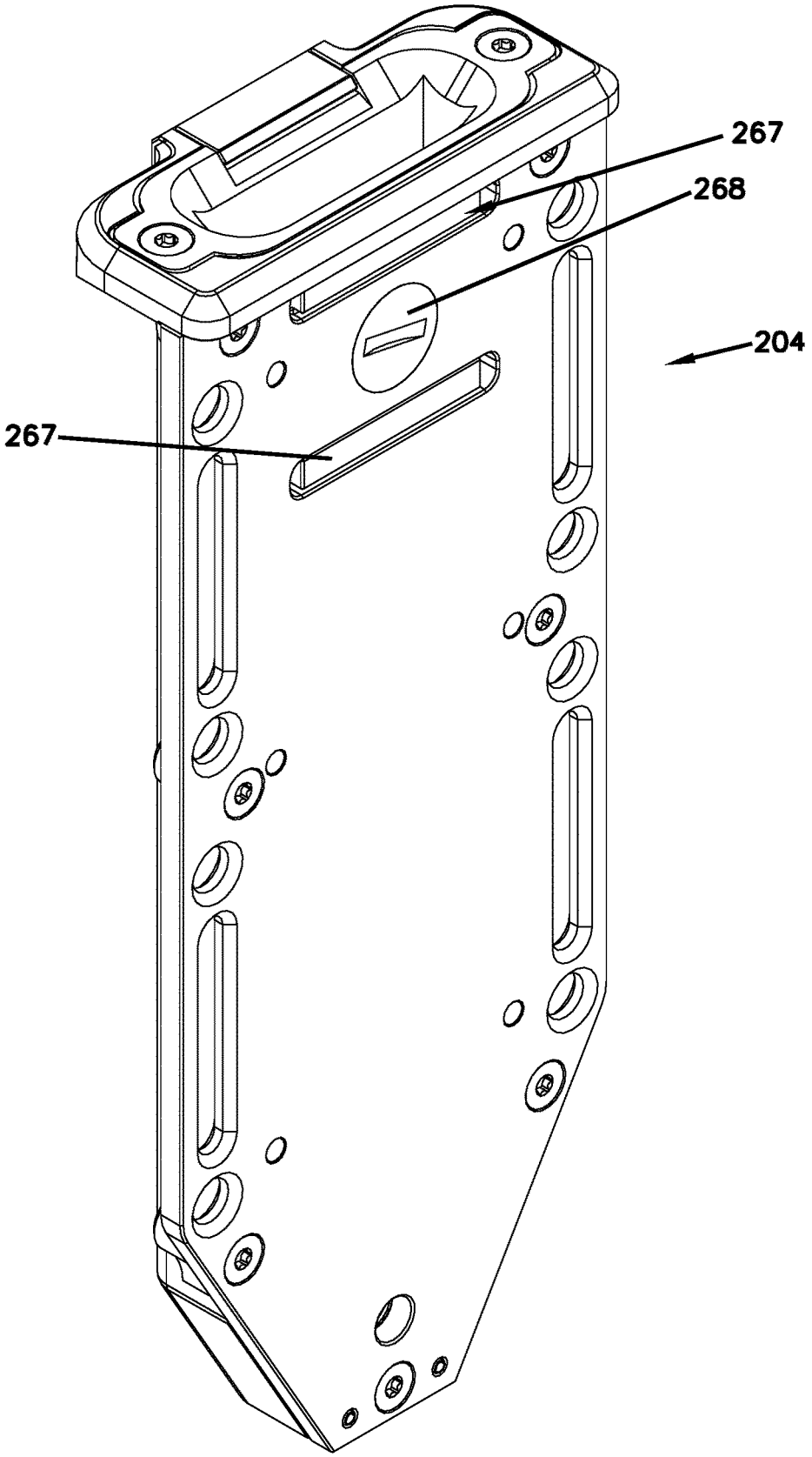
FIG. 19 illustrates a rear perspective view of the sheath of FIG. 18.

FIGS. 18 and 19 show a sheath 204 according to one embodiment of the present disclosure. The sheath 204 is substantially similar to the sheath 104 described above. The sheath 204 includes a latch 206 and an adjustable knife retention element 265.

The latch 206 is substantially similar to the latch 106 above, except that latch 206 is configured to be selectively held in the unlatched (i.e., open) position. For example, the latch 206 can be pivoted to the unlatched position when removing the knife 102 from the sheath 204. The latch 206 can then remain in the unlatched position until being manually pivoted to the latched position. This pivoting back to the latched position can occur, for example, once the knife 102 has been placed back in the sheath 204. By retaining the latch 206 in the unlatched position, it allows the knife 102 to be removed and replaced within the sheath 204 without the latch 206 contacting the blade 108 of the knife 102. In some examples, the latch 206 includes a button 230 that is held open using at least one plunger assembly 202 positioned within at least one plunger pin recess 203 of the sheath 204. The at least one plunger assembly 202 is configured to be a locking feature that is configured to hold the latch 206 in the unlatched position.

The adjustable knife retention element 265 is substantially similar to the friction spring 168. The adjustable knife retention element 265 can provide pressure to the blade 108 of the knife 102 when the knife 102 is positioned within a cavity 226 of the sheath 204 so as to prevent any jostling of the knife 102 within the cavity 226 and to aid in retention. The adjustable knife retention element 265 utilizes a biasing component 267 and a fastener 268. As the fastener 268 is tightened, pressure is increased on the component 267, and therefore retention is increased within the sheath 204.

Figure 20:
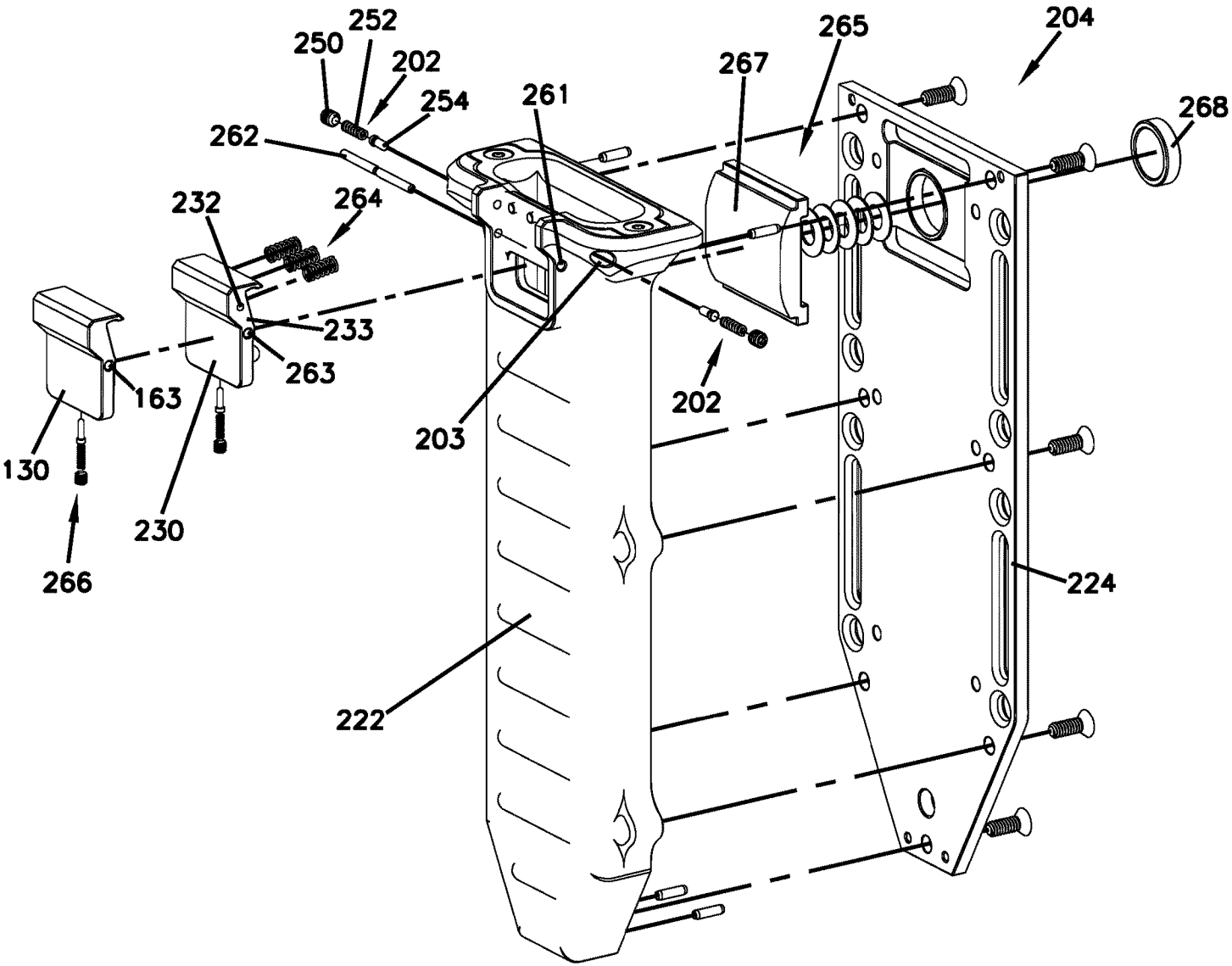
FIG. 20 illustrates a partially exploded view of the sheath of FIG. 18.

FIG. 20 shows an exploded view of the sheath 204, similar to FIG. 12. Like the sheath 104 above, the sheath 204 includes a front portion 222 that is separable from the back portion 224. Further, the latch 206 is shown to include a pair of plunger assemblies 202, the button 230, a latch pin 262, a series of springs 264, and a detent assembly 266. Also, the adjustable knife retention element 265, specifically the component 267 and fastener 268, is shown separated from the back portion 224.

FIG. 20. also shows the button 230 and the button 130 as two separate options that can be used with the sheath 204. The buttons 130, 230 are installed within the sheath 204 by way of the latch pin 262 that passes through an aperture 163, 263 in each button 130, 230 and is seated within a latch pin aperture 261 in the sheath 204. The buttons 130, 230 are configured to be pivotable about the latch pin 262.

Figure 23:
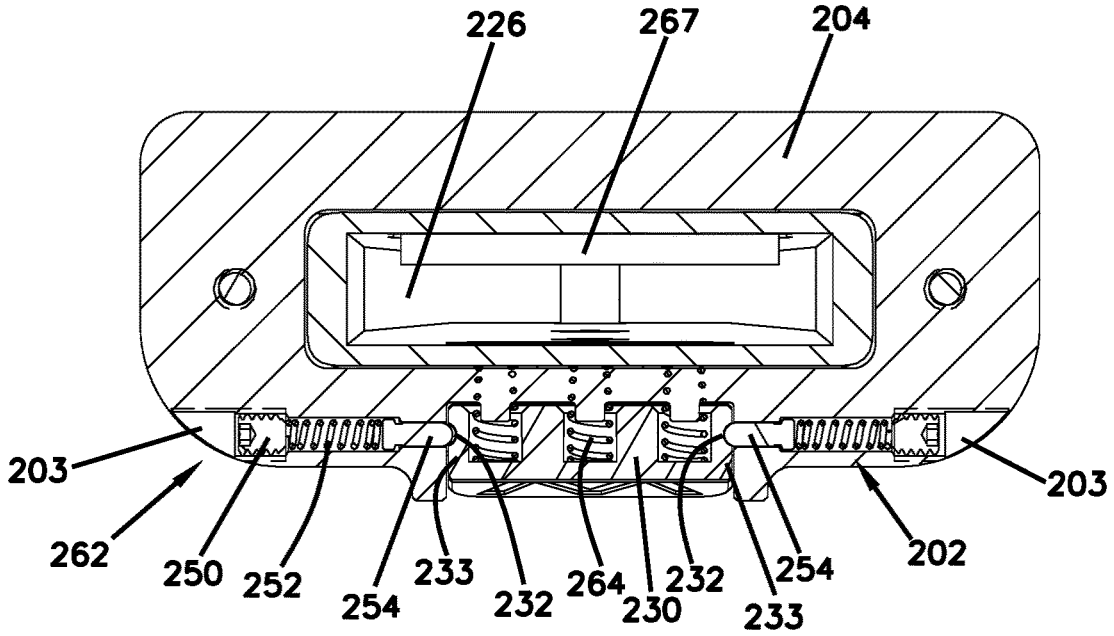
FIG. 23 illustrates a cross-sectional view of the sheath along line 23-23 of FIG. 21.

The button 230 differs from button 130, as button 230 includes a locking feature 232 that is configured to interface with at least one plunger assembly 202. In some examples, the locking feature 232 is a recess. In other examples, the locking feature 232 is a projection. In the depicted example, the locking feature 232 is an indentation that is disposed on either side 233 of the button 230 (as shown in FIG. 23).

In the depicted example, the plunger assembly 202 includes a set screw 250, a spring 252, and a pin 254. The plunger assembly 202 is configured to be positioned within the plunger pin recess 203 of the sheath 204. Specifically, the pin 254 is configured to interface with the locking feature 232 of the button 230 to hold the latch 206, specifically the button 230, in the unlatched position. The spring 252 allows the pin 254 to be spring loaded so that the pin 254 is held in place in the locking feature 232 of the button 230, but can also be disengaged from the locking features 232 by manually pivoting the button 230 and overcoming the spring force of the spring 252. In some examples, the set screw 250 can be used to adjust the amount of force that the spring 252 exerts on the pin 254, thereby affecting the locking characteristics of the button 230. For example, the set screw 250 can be tightened to increase the holding force of the pin 254 within the locking feature 232 of the latch 206, thereby requiring a higher manual force from the user to disengages the pin 254 from the locking feature 232.

The adjustable knife retention element 265 is shown to include the biasing component 267 and fastener 268. In the depicted example, a series of spring washers 269 are utilized between the fastener 268 and the spring-like component. 267. In some examples, the washers 269 are disc springs and are configured to be selectively compressed by the fastener 268, thereby exerting a higher and higher force on the biasing component 267. When the force is increased on the biasing component 267, the retention force on the blade 108 of the knife 102 is increased.

Figure 21:
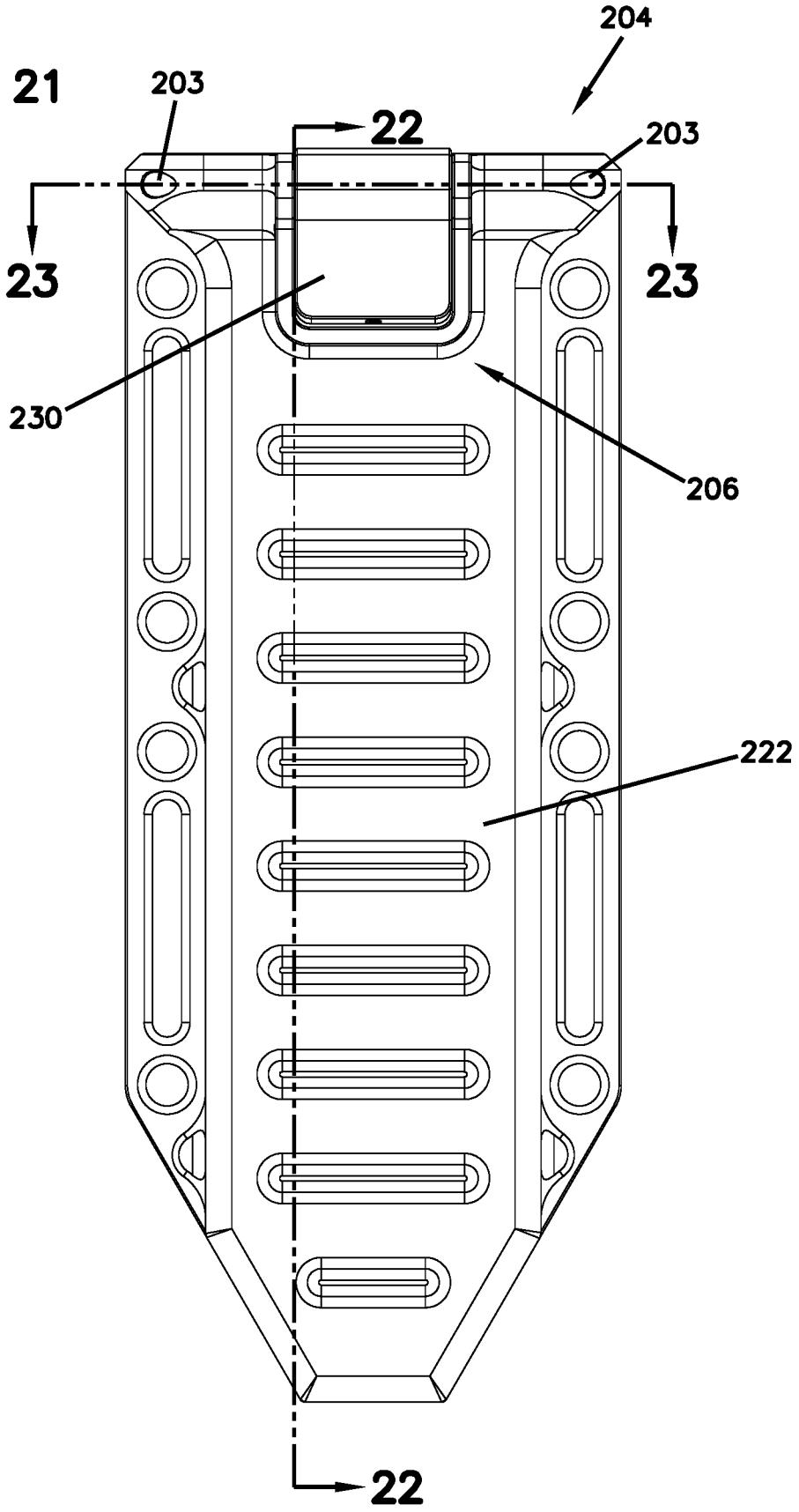
FIG. 21 illustrates a front view of the sheath of FIG. 18.
Figure 22:
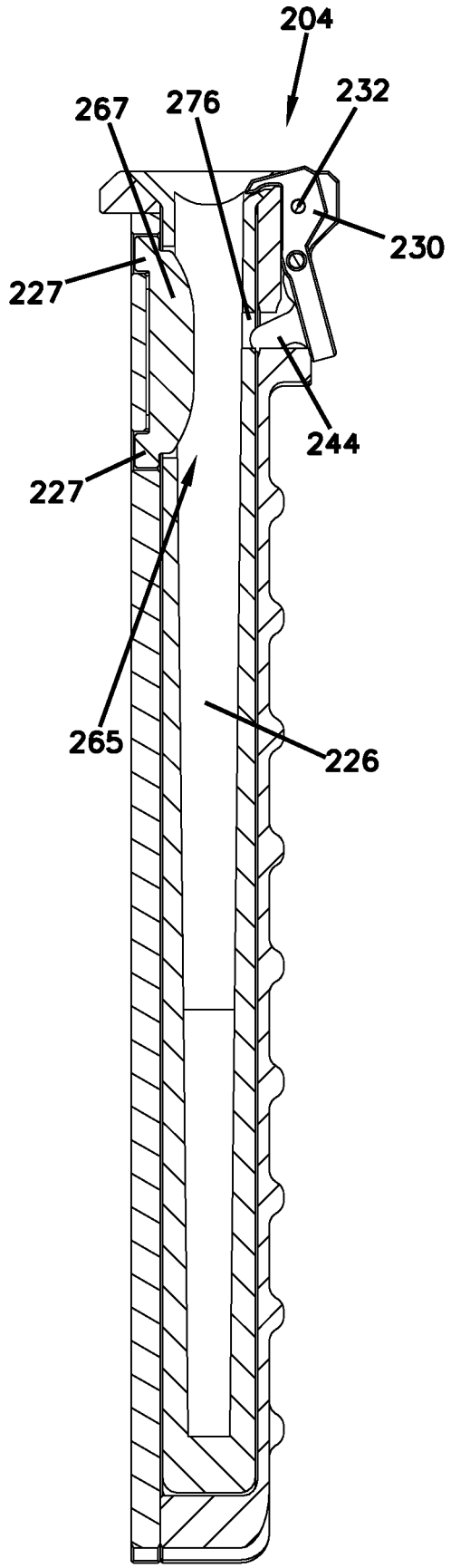
FIG. 22 illustrates a cross-sectional view of the sheath along line 22-22 of FIG. 21.

FIG. 21 shows a front view of the sheath 204. FIG. 22 shows a cross section of the sheath along line 22-22 of FIG. 21. The button 230 is shown in the unlatched position. In the depicted example, the button 230 includes a projection 244 that projects out of a window 276 in the sheath 204 when held in the unlatched position. The projection can then be moved back within the window 276 and enter the cavity 226 when the button 230 is pivoted to the latched position.

The biasing component 267 is shown to be at least partially within the cavity 226. In some examples, the biasing component 267 can include a pair of arms 227 that interface with a portion of the sheath 204 so as to retain the biasing component 267 within the sheath 204.

FIG. 23 shows a cross section of the sheath 204 along line 23-23 of FIG. 21. As shown, the pair of plunger assemblies 202 are positioned within the plunger pin recesses 203 of the sheath 204. Specifically, the pins 254 of each plunger assembly 202 are shown engaged with the locking feature 232 of the button 230 on either side 233 so as to retain the button 230 in the unlatched position. In other examples, a variety of other methods can be used to retain the button 230 in the unlatched position such as additional pins, a secondary latch keeping the button 230 in the unlatched position, or an additional spring member that biases the button 230 into the unlatched position.

Figure 24:
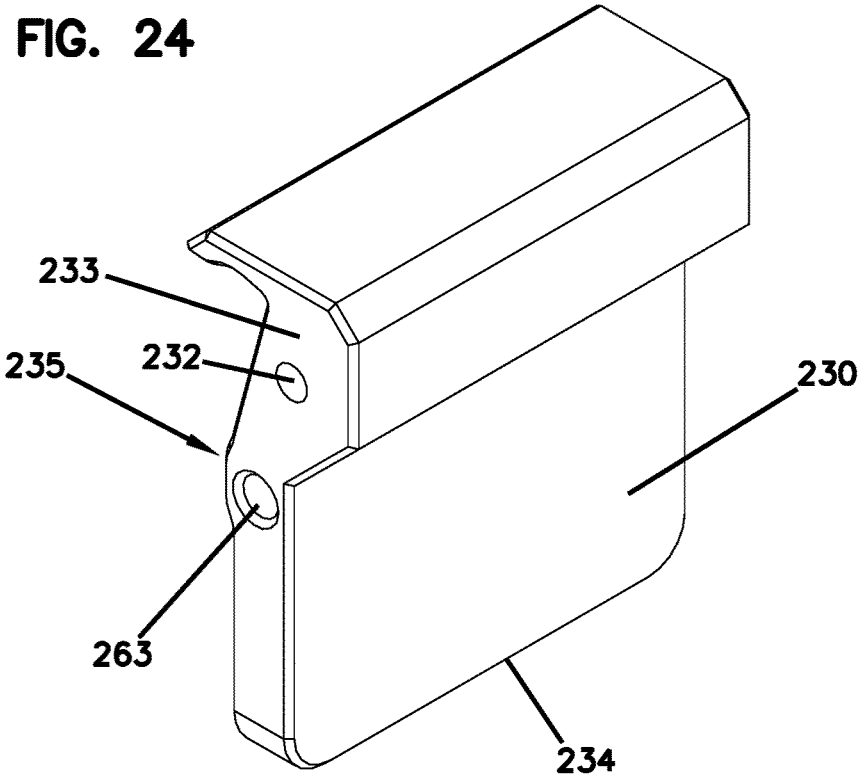
FIG. 24 illustrates a perspective view of a latch of the sheath of FIG. 18.

FIG. 24 shows a perspective view of the button 230. Clearly shown is the locking feature 232 in the side 233 of the button 230. In other examples, the locking feature 232 can be located elsewhere on the button 230 such as, for example, a bottom side 234 or a back side 235.

Figure 25:
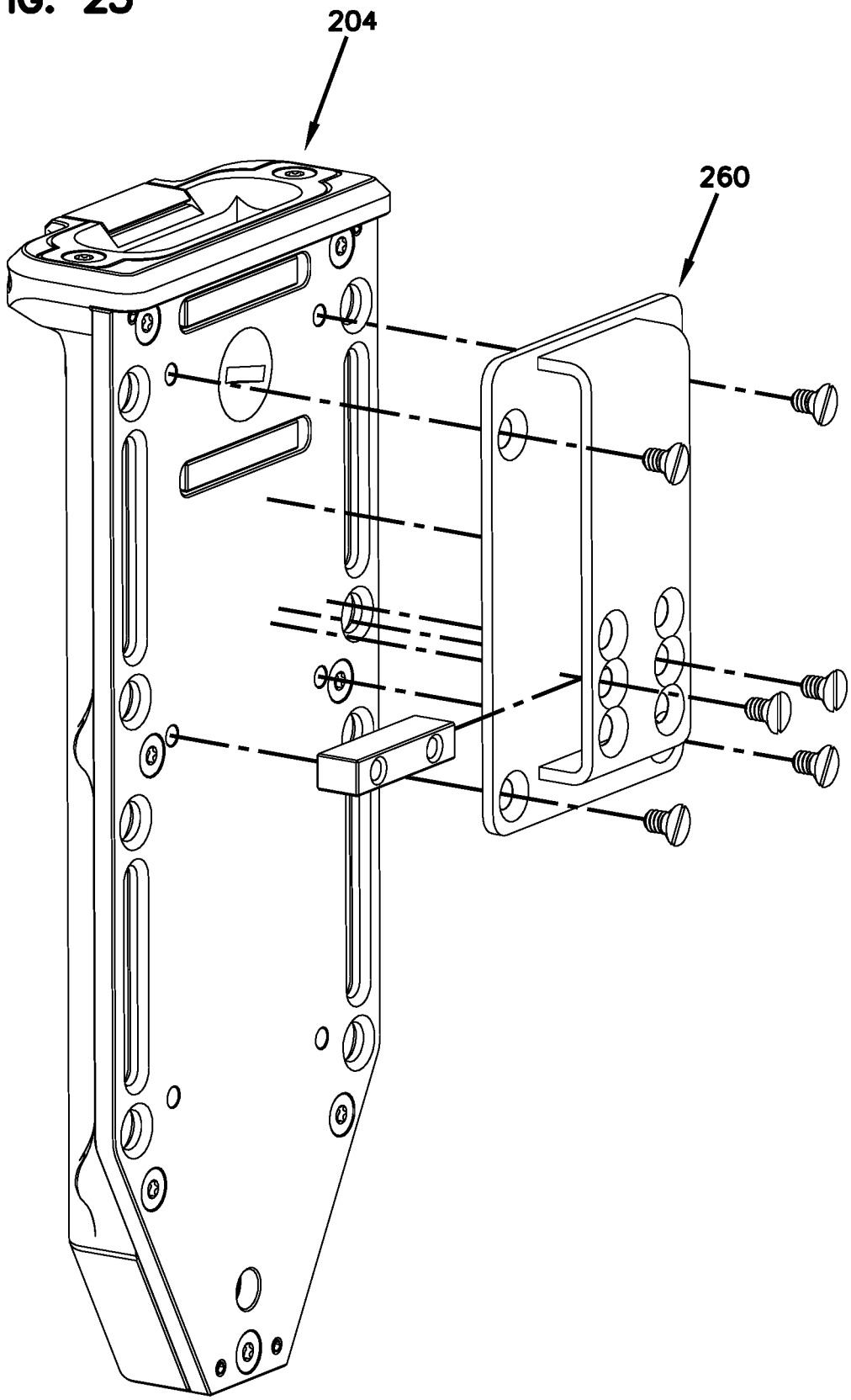
FIG. 25 illustrates a partially exploded view of a mounting solution for the sheath of FIG. 18, according to one embodiment of the present disclosure.

FIG. 25 shows the sheath 204 with a removable MOLLE mounting plate 246 detached therefrom. The MOLLE mounting plate 246 is substantially similar to the MOLLE mounting plate 146 described above.

Figure 26:
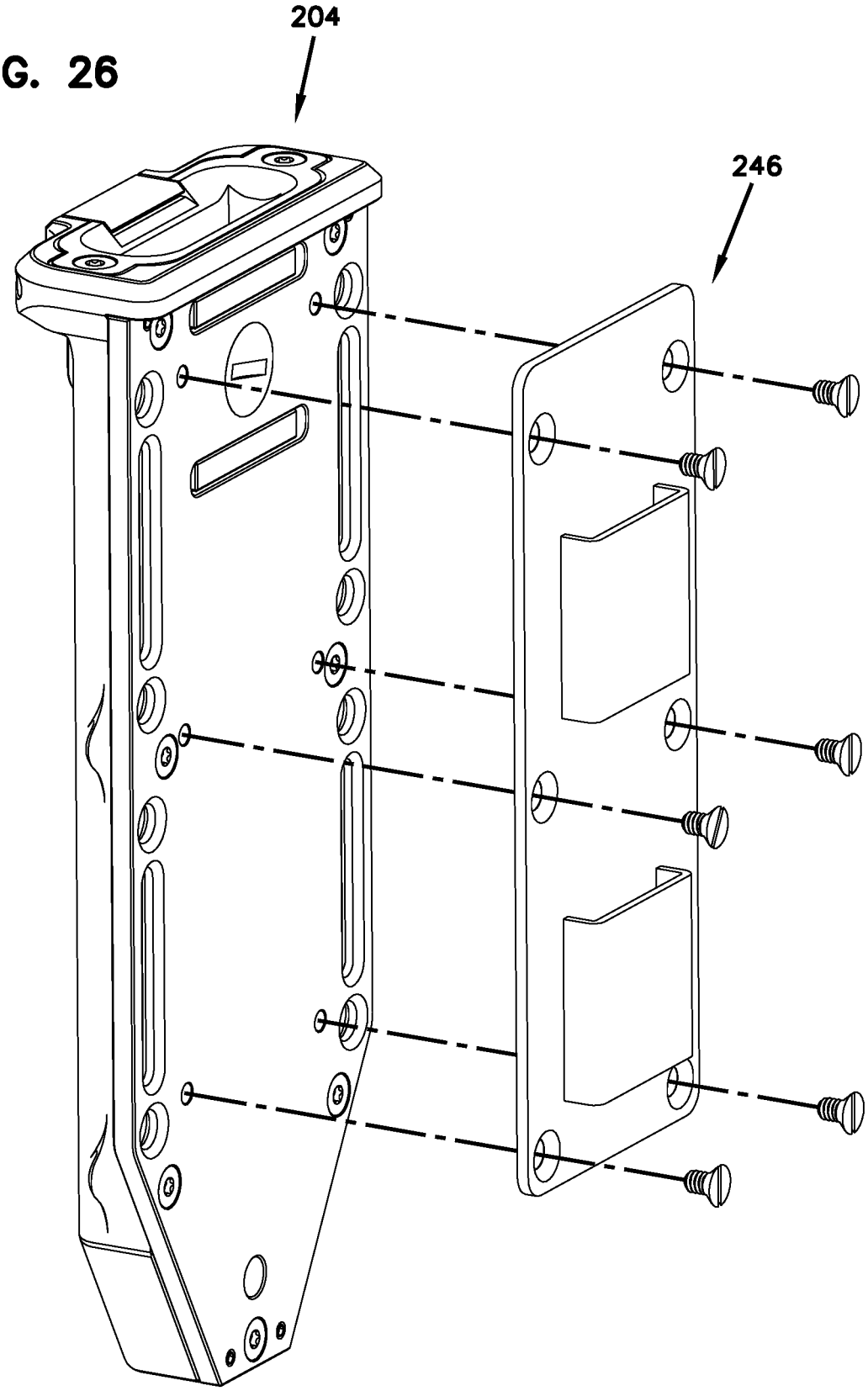
FIG. 26 illustrates a partially exploded view of a mounting solution for the sheath of FIG. 18, according to one embodiment of the present disclosure.

FIG. 26 shows the sheath 204 with a removable belt mounting plate 260 detached therefrom. The belt mounting plate 260, is substantially similar to the belt mounting plate 154 described above.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A sheath for a knife, the sheath comprising:

a main body comprising a top face, a front face and a pair of side faces, the front face being wider than the side faces and comprising a window formed therein;

a cavity defined by the main body, the cavity having an opening in the top face and being configured to receive at least a portion of a blade of the knife, wherein the window adjoins the cavity; and a latch disposed in the front face of the main body, the latch being spring loaded and having a projection at least partially positionable within the cavity by way of the window, wherein the latch comprises a button and a latch pin, the button being at least partially disposed in the top face of the sheath, and the latch being configured to be pivotable about the latch pin when a force is applied to the button.

2. The sheath of claim 1, wherein the main body includes a back portion and a front portion, wherein the front portion is secured to the back portion.

3. The sheath of claim 2, wherein the back portion includes a plurality of attachment points.

4. The sheath of claim 1, further comprising a spring at least partially positioned within the cavity.

5. The sheath of claim 1, wherein the main body is manufactured from metal.

6. The sheath of claim 1, wherein the latch is pivotable between a latched position and an unlatched position, wherein, when in the latched position, the projection is positioned within the cavity, and wherein, when in the unlatched position, the projection is positioned outside of the cavity.

7. The sheath of claim 6, wherein the latch can be held in the unlatched position by a portion of the sheath.

8. The sheath of claim 1, wherein the button includes a locking feature that is configured to interface with a locking feature in the sheath so as to selectively lock the button, and thereby the latch, in the unlatched position.

9. The sheath of claim 1, wherein the latch includes a detent assembly, wherein the detent assembly is adjustable to alter the pivotable movement of the latch.

10. The sheath of claim 9, wherein the detent assembly includes a spring loaded pin that contacts a pivot point of the latch.

11. The sheath of claim 1, wherein the projection is configured to directly engage the blade.

12. A sheath and knife combination, comprising:

a knife having a tang and a blade;

a sheath including:

a main body having a least a top face, a front face, and a pair of side faces, the front face being wider than the side faces and comprising a window formed therein;

a cavity defined by the main body, the cavity having an opening in the top face, the cavity being sized and shaped to receive at least the blade of the knife, wherein the window adjoins the cavity; and a latch disposed in the front face of the main body, the latch being spring loaded and having a projection at least partially positionable within the cavity by way of the window, wherein the latch comprises a button and a latch pin, the button being at least partially disposed in the top face of the sheath, and the latch being configured to be pivotable about the latch pin when a force is applied to the button.

13. The sheath and knife combination of claim 12, wherein the blade further comprises a slot.

14. The sheath and knife combination of claim 12, wherein the projection of the latch is configured to interface with the slot of the blade.

15. The sheath and knife combination of claim 12, wherein the knife includes a handle at least partially positioned around the tang.

16. The sheath and knife combination of claim 12, wherein the latch is pivotable between a latched position and a released position, whereby pivoting the latch from the latched position to the released position releases the knife from the sheath.

* * * * *